US007246394B2

(12) United States Patent
Wang

(10) Patent No.: US 7,246,394 B2
(45) **Date of Patent: *Jul. 24, 2007**

(54) INFLATABLE PRODUCT WITH BUILT-IN HOUSING AND SWITCHING PIPE

(75) Inventor: Cheng Chung Wang, Taipei (TW)

(73) Assignee: Team Worldwide Corporation, Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/326,829

(22) Filed: Jan. 7, 2006

(65) Prior Publication Data

US 2006/0112492 A1 Jun. 1, 2006

Related U.S. Application Data

(62) Division of application No. 09/886,030, filed on Jun. 22, 2001, now Pat. No. 6,990,700.

(51) Int. Cl.
*A47C 27/08* (2006.01)

(52) U.S. Cl. ..... 5/713; 5/708; 5/655.3

(58) Field of Classification Search ..... 5/706, 5/708, 713, 655.3; 417/411, 315, 238–239; 137/625.22, 565.12
See application file for complete search history.

(56) References Cited

U.S. PATENT DOCUMENTS

| | | | |
|---|---|---|---|
| 388,037 | A | 8/1888 | Hargin |
| 1,722,595 | A | 7/1929 | Rose |
| 2,780,222 | A | 2/1957 | Polzin et al. |
| 3,303,518 | A | 2/1967 | Ingram |
| 4,306,322 | A | 12/1981 | Young et al. |
| 4,435,864 | A | 3/1984 | Callaway |
| 4,520,847 | A | 6/1985 | Baron |
| 4,619,481 | A | 10/1986 | Grudzinskas |
| 4,862,533 | A | 9/1989 | Adams, III |
| 4,865,580 | A | 9/1989 | Berger et al. |
| 4,890,344 | A | 1/1990 | Walker |
| 5,068,933 | A | 12/1991 | Sexton |
| 5,249,319 | A | 10/1993 | Higgs |
| 5,279,018 | A | 1/1994 | Glen, III |
| 5,297,545 | A | 3/1994 | Infante |
| 5,299,599 | A | 4/1994 | Farmer et al. |
| 5,367,726 | A | 11/1994 | Chaffee |
| 5,397,950 | A | 3/1995 | Norbury, Jr. et al. |

(Continued)

FOREIGN PATENT DOCUMENTS

DE 29721150 U1 3/1998

OTHER PUBLICATIONS

Instruction sheet for "Insta-Bed", Sep. 2000, USA.

*Primary Examiner*—Patricia Engle
*Assistant Examiner*—Fredrick Conley
(74) *Attorney, Agent, or Firm*—Quintero Law Office

(57) ABSTRACT

An inflatable product includes an inflatable body, a fan and motor assembly for pumping air, a housing built into the inflatable body, and an air conduit disposed at least in part in the housing. The housing has an interior region. The air conduit is movable between a first position and a second position, the fan and motor inflating the inflatable body when the air conduit is in the first position, and deflating the inflatable body when the air conduit is in the second position. Air flows between the interior region of the housing and the inflatable body during inflation and deflation.

23 Claims, 33 Drawing Sheets

U.S. PATENT DOCUMENTS

| | | | | |
|---|---|---|---|---|
| 5,542,136 | A | 8/1996 | Tappel | |
| 5,606,756 | A | 3/1997 | Price | |
| 5,624,242 | A | 4/1997 | Wu | |
| 5,794,289 | A | 8/1998 | Wortman et al. | |
| 6,098,221 | A | 8/2000 | Kloppenborg | |
| 6,098,245 | A | 8/2000 | Satterfield et al. | |
| 6,119,292 | A | 9/2000 | Haas | |
| 6,158,978 | A | 12/2000 | Norbury, Jr. | |
| 6,182,656 | B1 | 2/2001 | Sagiv | |
| 6,287,095 | B1 | 9/2001 | Saputo et al. | |
| 6,332,760 | B1 * | 12/2001 | Chung | 417/411 |
| 6,431,845 | B1 | 8/2002 | Thomas et al. | |
| 6,457,192 | B2 | 10/2002 | Choi et al. | |
| 6,485,276 | B2 | 11/2002 | Yang | |
| 6,591,437 | B1 | 7/2003 | Phillips | |
| 6,832,629 | B2 | 12/2004 | Wu | |
| 6,832,630 | B2 | 12/2004 | Wu | |
| 7,039,972 | B2 | 5/2006 | Chaffee | |
| 7,040,347 | B2 * | 5/2006 | Wang | 137/625.22 |
| 2001/0044969 | A1 | 11/2001 | Chaffee | |
| 2004/0073999 | A1 | 4/2004 | Fruge | |

* cited by examiner

INFLATABLE PRODUCT WITH BUILT-IN HOUSING AND SWITCHING PIPE

CROSS-REFERENCE TO RELATED APPLICATION

This application is a divisional of U.S. application No. Ser. No. 09/886,030, filed Jun. 22, 2001, now U.S. Pat. No. 6,990,700.

BACKGROUND OF THE INVENTION

1. Field of the Invention

The present invention relates in general to an inflatable product provided with an electric air pump.

2. Description of the Related Art

Referring to FIG. 11, prior art provides a conventional air mattress for two people with a top fabric cover 100, a layer of foam 200, two inflatable chambers 300, 400, a frame 500 and a bottom fabric cover 600. The inflatable chambers 300, 400 are inflated by an electric air pump (not shown), which is separately provided, requiring users to carry two items, the air mattress itself, and an electric air pump. Inconvenience results, especially for outdoor use.

The present invention provides a modified air mattress, which has a built-in electric air pump eliminating the need for an external pump. Furthermore, operation of the air mattress of the present invention is easy.

SUMMARY OF THE INVENTION

An object of the present invention is to provide an air mattress, easily operated and conveniently carried.

The air mattress of the present invention includes a chamber and an electric air pump for inflating the chamber. The air pump has an air intake and an air outlet. The air intake is connected to the outside of the chamber and the air outlet is connected to the inside of the chamber when the air pump is moved to first position. The air intake is connected to the inside of the chamber and the air outlet is connected to the outside of the chamber when the air pump is moved to second position.

BRIEF DESCRIPTION OF THE DRAWINGS

The present invention can be more fully understood by reading the subsequent detailed description and examples with references made to the accompanying drawings, wherein.

DETAILED DESCRIPTION OF THE PREFERRED EMBODIMENT

Figure 1A:
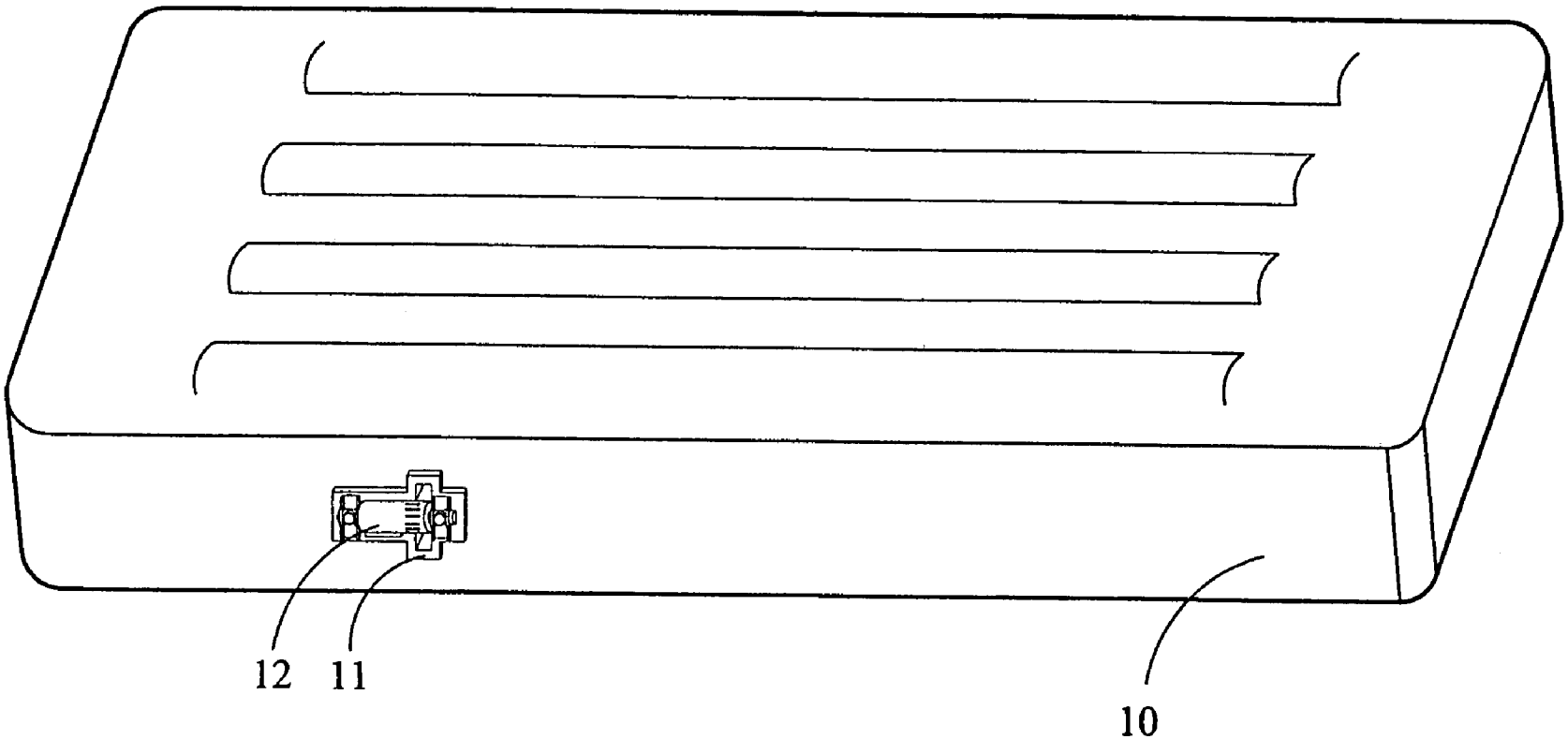
FIG. 1A is a perspective diagram of an inflatable product in accordance with a first embodiment of the present invention.
Figure 1B:
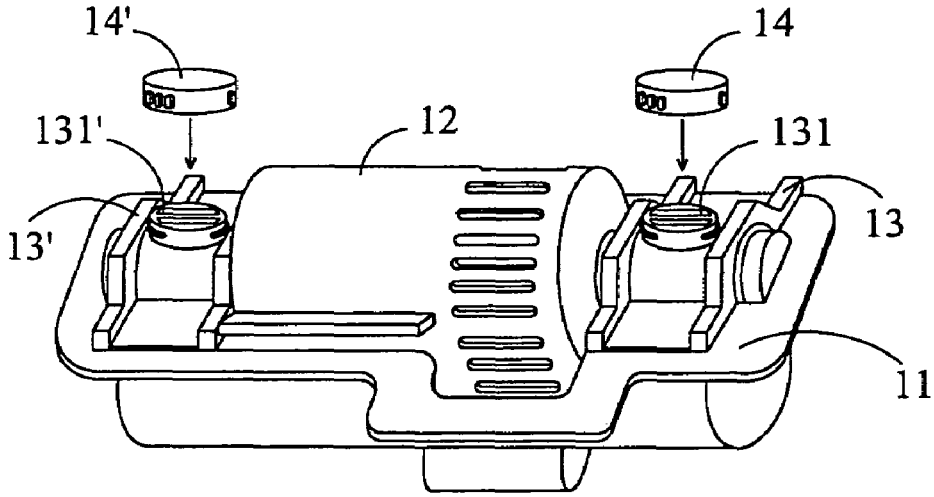
FIG. 1B is an expanded view of the inflatable product of the first embodiment of the present invention.
Figure 1C:
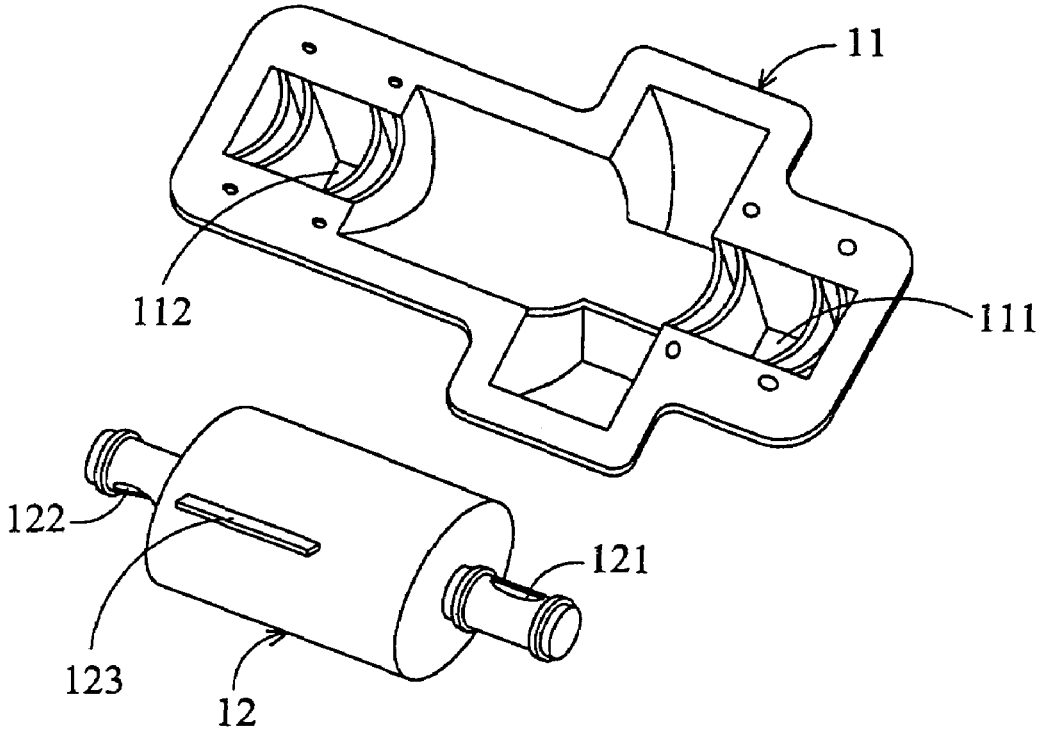
FIG. 1C is an exploded diagram of the air pump and pump seat of FIG. 1B.
Figure 1D:
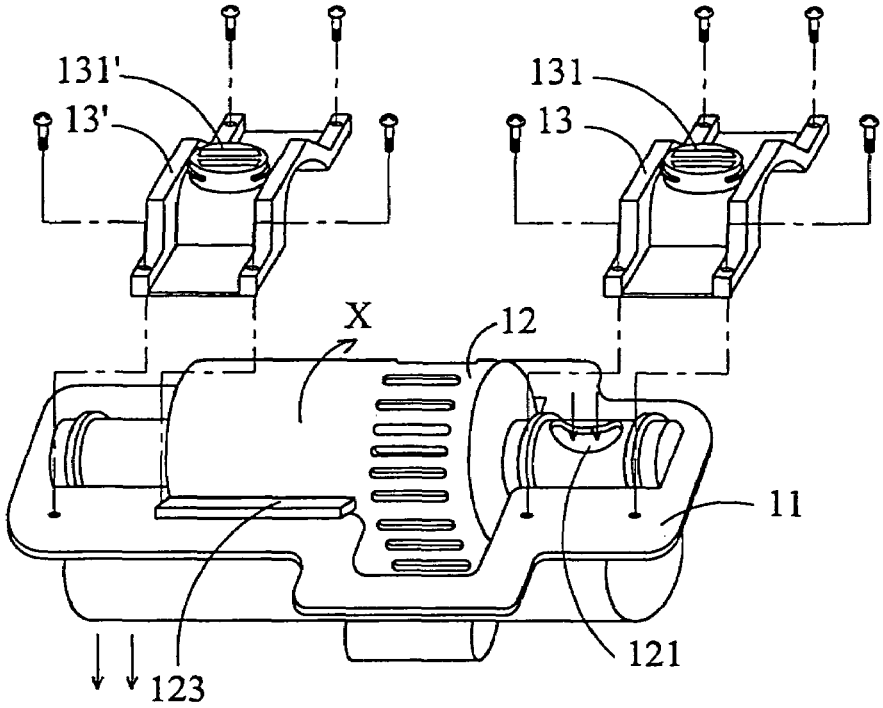
FIG. 1D is a schematic diagram of the air pump of the first embodiment during inflation.

Referring to FIGS. 1A and 1B, an inflatable product of a first embodiment of the present invention has an inflatable chamber 10, a pump seat 11 mounted on the chamber 10, an air pump 12 carried by the pump seat 11, two holding elements 13, 13' to hold the air pump 12, and two covers 14, 14' for covering the vents 131, 131' provided on the holding elements 13. Referring to FIG. 1C, the seat 11 has two holes 111, 112 on its bottom, through which air enters the chamber 10. The air pump 12 has a substantially rolling-pin-shaped housing with a fan and motor (not shown) inside. An air intake 121 and an air outlet 122 are provided at opposite ends of the housing. The housing of the air pump 12 has a rib 123 on its outer surface, wherein the rib 123 extends in the axial direction of the housing. Referring to FIG. 1D, the air pump 12 is carried by the seat 11 with the rib 123 resting on the seat 11. Then, the holding elements 13 are screwed to the seat 11 for holding the air pump 12.

During inflation, the air pump 12 pumps air into the inflatable product. Air flows through the vent 131 of the holding element 13, the air intake 121 and air outlet 122 of the air pump 12, and the hole 112 on the bottom of the seat 11. Air then flows into the inflatable product via the hole 112 on the bottom of the seat 112.

Figure 1E:
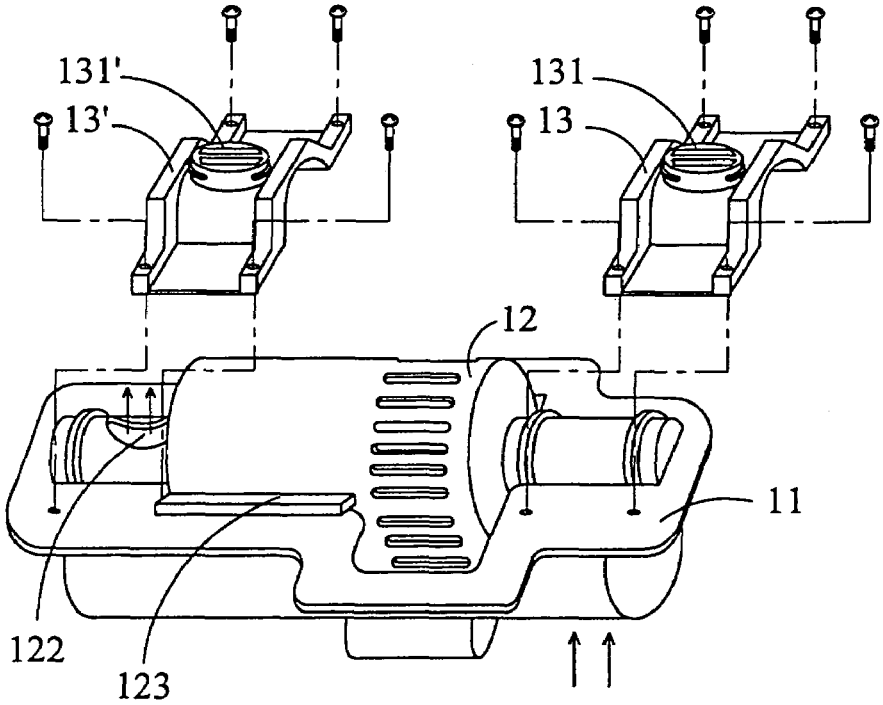
FIG. 1E is a schematic diagram of the air pump of the first embodiment during deflation.

During deflation, the air pump 12 is rotated in direction X until the rib 123 rests on the seat 11 at another side. As shown in FIG. 1E, the air intake 121 faces down and the air outlet 122 faces up so that the air pump 12 can pump air out of the inflatable product. Air flows through the hole 111 of the seat 11, the air intake 121 and air outlet 122 of the air pump 12, and then out from the vent 131' of the holding element 13'.

Figure 2A:
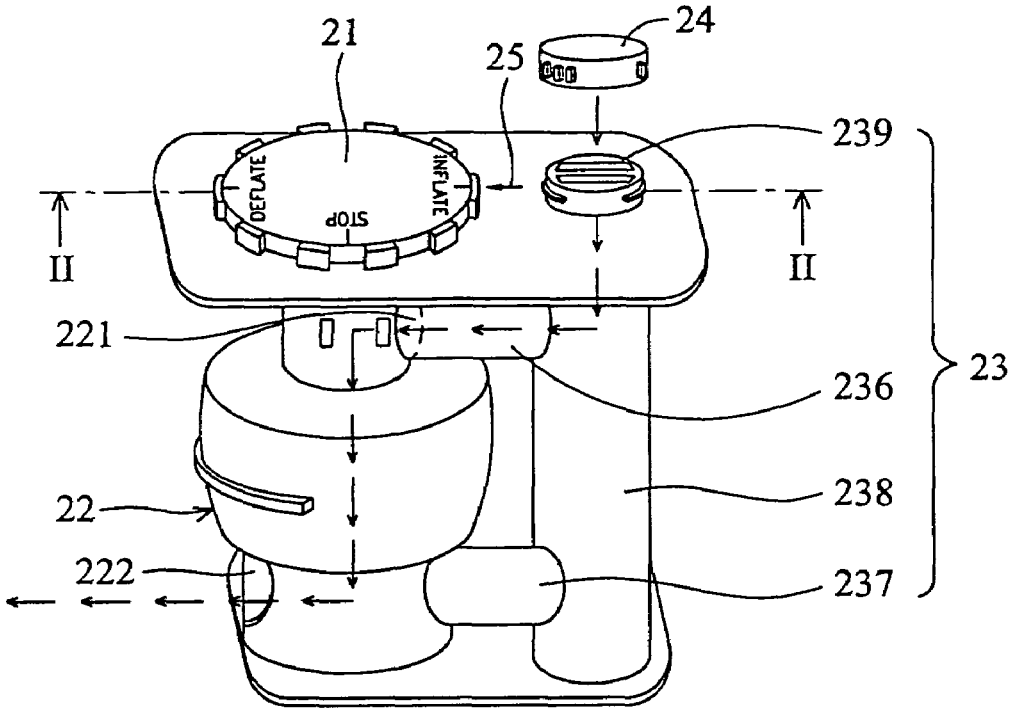
FIG. 2A depicts an air pump of a second embodiment of the present invention during inflation.
Figure 2B:
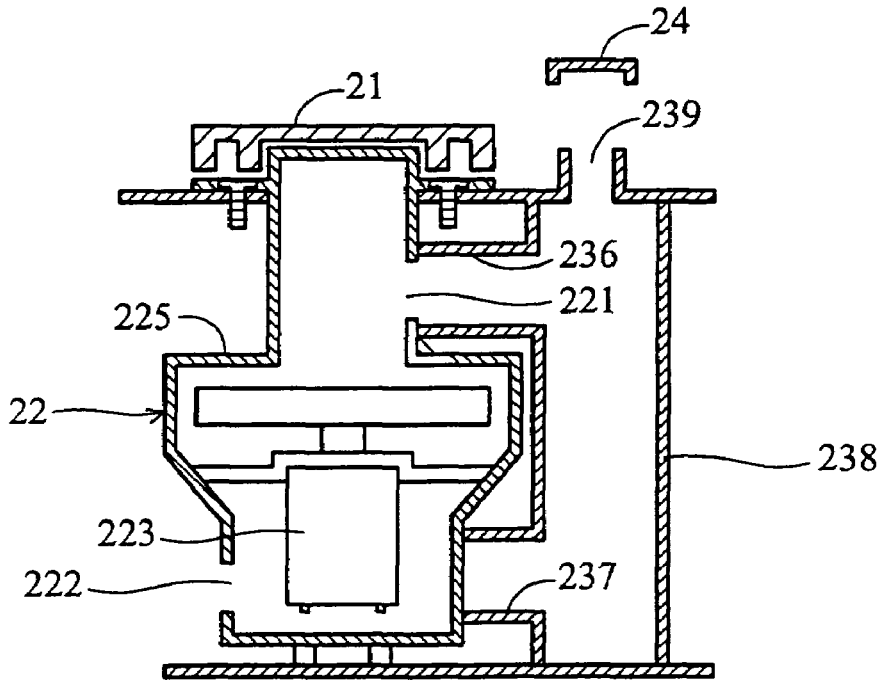
FIG. 2B is a sectional view of FIG. 2A along line II-II.

Referring to FIG. 2A, an inflatable product of a second embodiment of the present invention is provided with a rotatable switch 21, an air pump 22, a piping system 23 and a cover 24. On the top surface of the switch 21, "INFLATE", "STOP" and "DEFLATE" settings appear. The air pump 22 is firmly connected to the switch 21. The air pump 22 thus follows the switch 21's rotation when twisted. Referring to FIG. 2B, the air pump 22 has a substantially rolling-pin-shaped housing 225 with a fan and motor 223 inside. An air intake 221 and an air outlet 222 are provided at opposite ends of the housing. The piping system 23 includes a main pipe 238, two side pipes 236, 237 and a vent 239. The main pipe 238 is connected to the outside via the vent 239 and connected to the air pump 22 in the housing 225 via the side pipes 236, 237. The cover 24 is used to close the vent 239.

During inflation, the switch 21 is rotated to "INFLATE". The air intake 221 is switched to connect the side pipe 236, while the side pipe 237 is closed by the housing 225 of the air pump 22. The air pump 22 pumps air into the inflatable product in accordance with a path as indicated by the arrows. In detail, air flows through the vent 239, main pipe 238, side pipe 236 and air intake 221, and out from the air outlet 222.

When inflation is finished, the user rotates the switch 21 to "STOP". The air pump 22 stops. Also, the air intake 221 and air outlet 222 are closed by the housing 225 of the air pump 22.

Figure 2C:
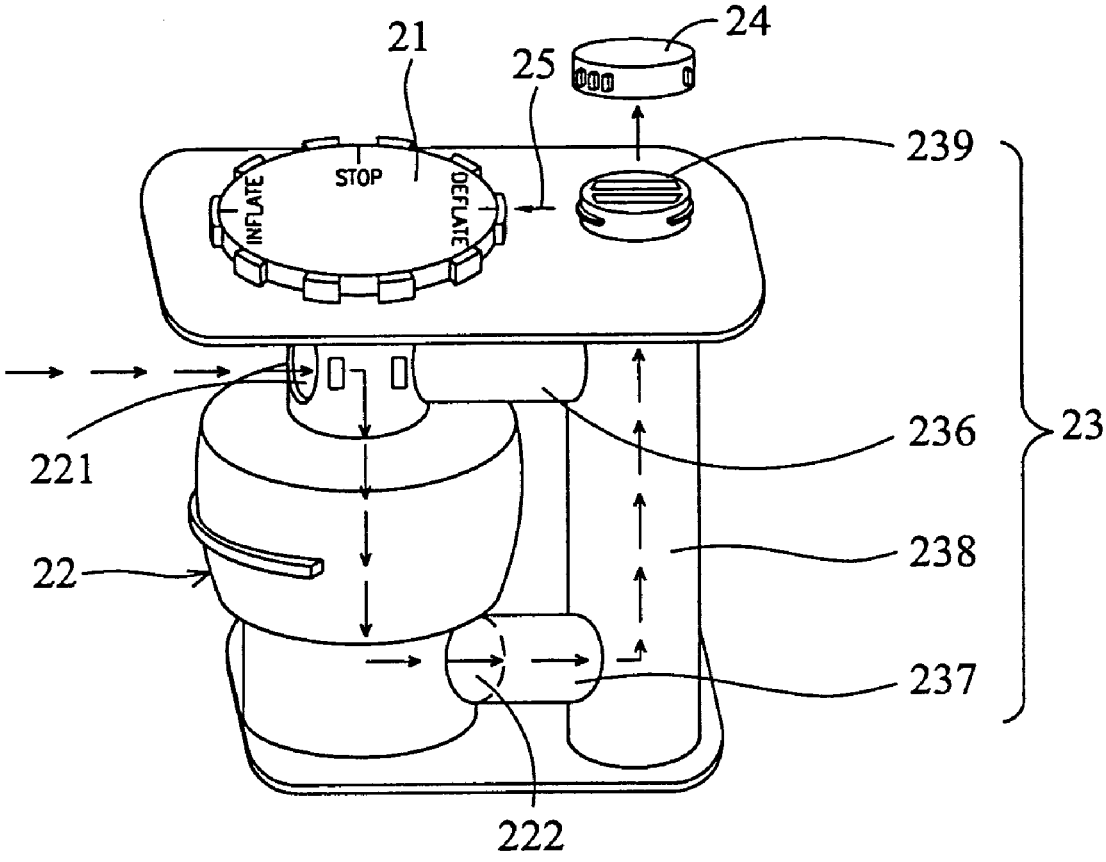
FIG. 2C depicts the air pump of the second embodiment of the present invention during deflation.

During deflation, the switch 21 is rotated to "DEFLATE". As shown in FIG. 2C, the air outlet 222 is switched to connect the side pipe 237, while the side pipe 236 is closed by the housing 225 of the air pump 22. The air pump 22 evacuates air from the inflatable product in accordance with a path as indicated by arrows. In detail, air flows through the air intake 221, air outlet 222, side pipe 237 and main pipe 238, and out from the vent 239.

Figure 3A:
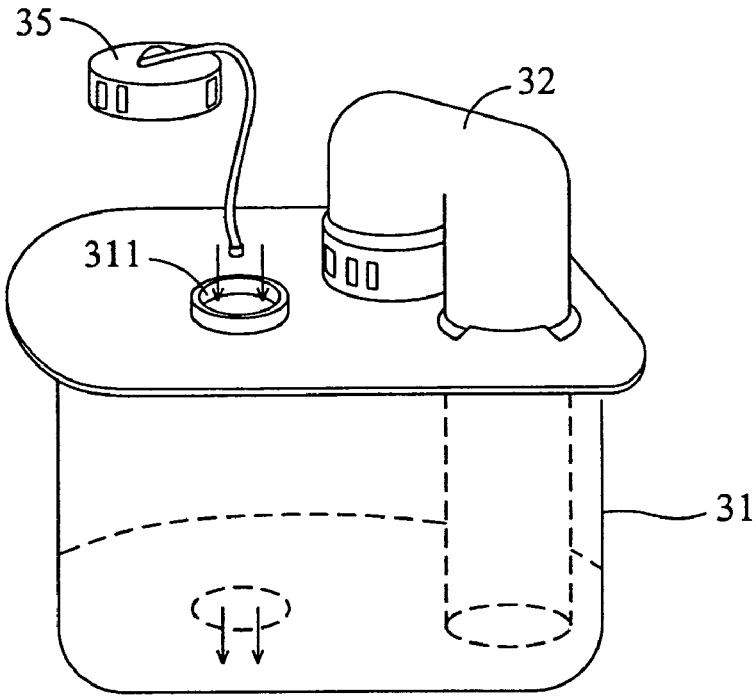
FIG. 3A depicts an air pump of a third embodiment of the present invention during inflation.
Figure 3B:
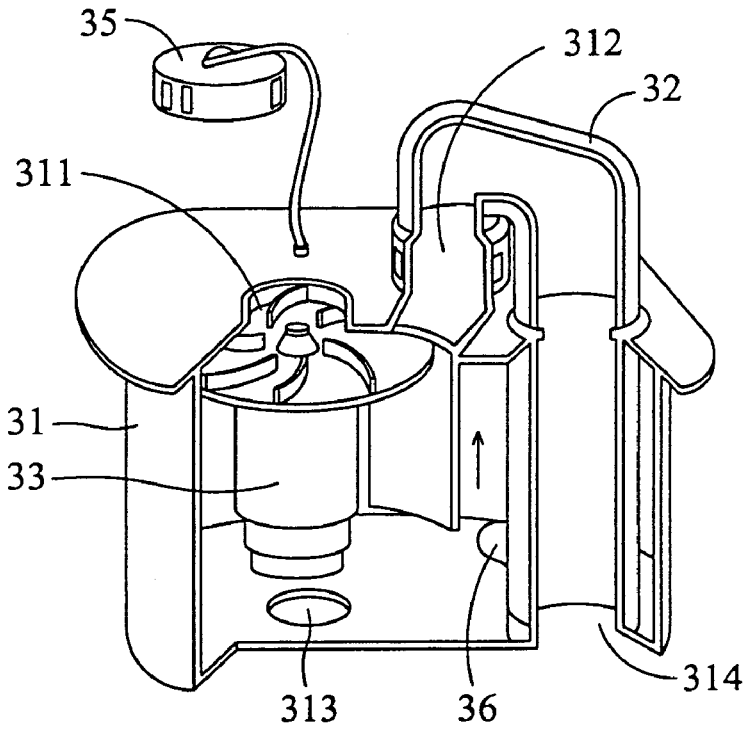
FIG. 3B depicts the air pump of FIG. 3A, with a part of the housing removed.

Referring to FIGS. 3A and 3B, an inflatable product of a third embodiment of the present invention is provided with a housing 31, a fan and motor 33, a switching pipe 32, a flap 36 and a cover 35. The fan and motor 33 is received in the housing 31. The flap 36 is firmly connected to the switching pipe 32. Therefore, when the switching pipe 32 is rotated, the flap 36 follows. An air intake 311 and an air outlet 312 are provided on the top surface of the housing 31, while another air intake 314 and air outlet 313 are provided on the bottom surface of the housing 31. During inflation, the switching pipe 32 is connected to the air outlet 312 on the top surface of the housing 31. The cover 35 is removed from the air intake 311. The inflatable product (not shown) is inflated by the fan and motor 33. Air flows through the air intake 311 and the air outlet 313, and into the inflatable product.

Figure 3C:
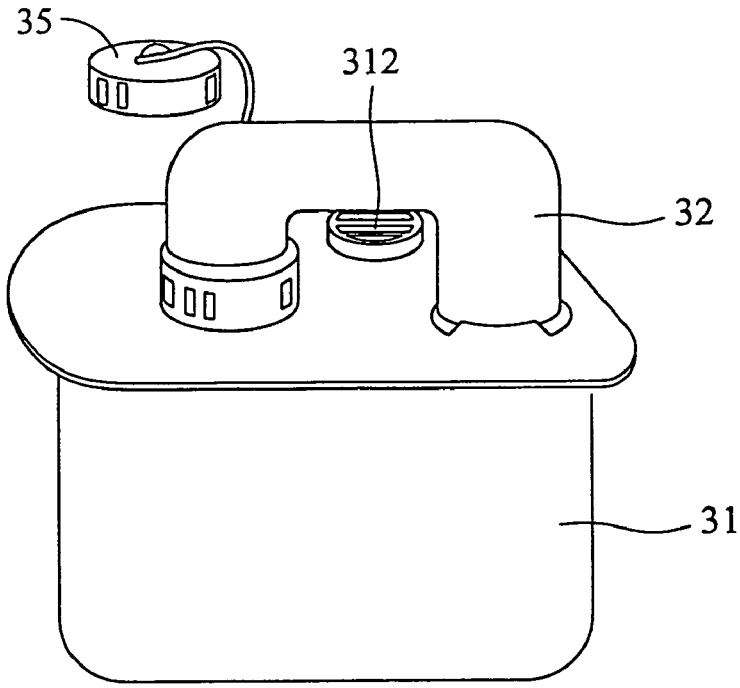
FIG. 3C depicts the air pump of the third embodiment of the present invention during deflation.
Figure 3D:
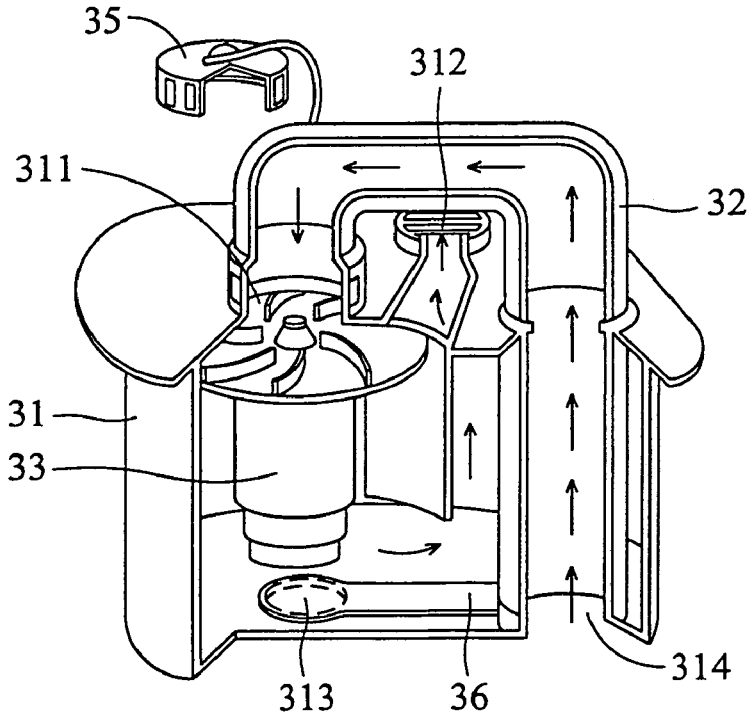
FIG. 3D depicts the air pump of FIG. 3C, with a part of the housing removed.

Referring to FIGS. 3C and 3D, During deflation, the switching pipe 32 is switched from the air outlet 312 to the air intake 311 on the top surface of the housing 31. Also, the flap 36 follows the switching pipe 32 to rotate to close the air outlet 313 on the bottom surface of the housing 31. The air in the inflatable product is evacuated by the fan and motor 33. The path of the airflow is indicated by arrows. Air flows through the air intake 314, the switching pipe 32 and the air intake 311, and into the housing 31. Then, air flows out from the air outlet 312.

Figure 4A:
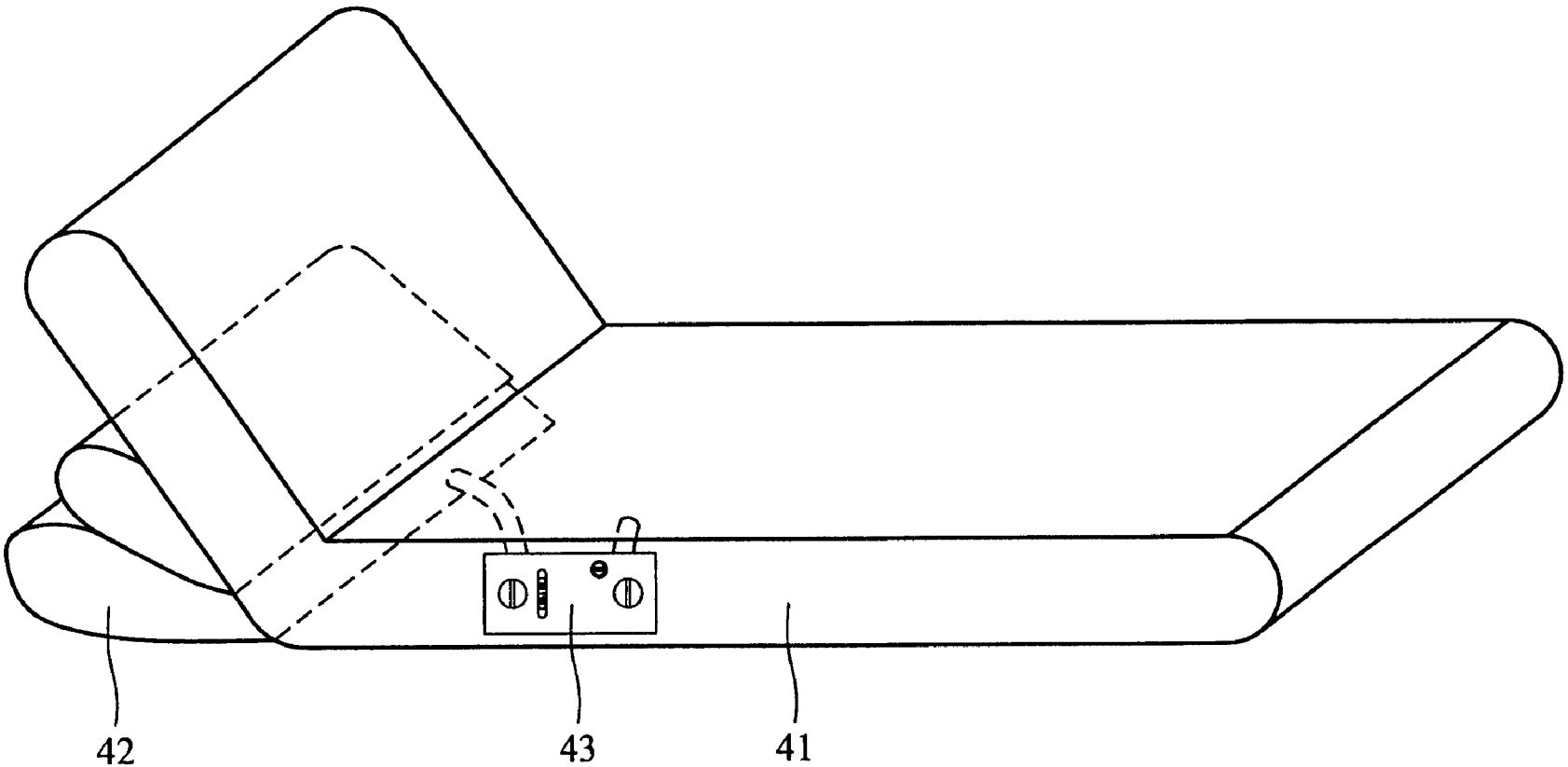
FIG. 4A is a perspective diagram of an inflatable product in accordance with a fourth embodiment of the present invention.
Figure 4B:
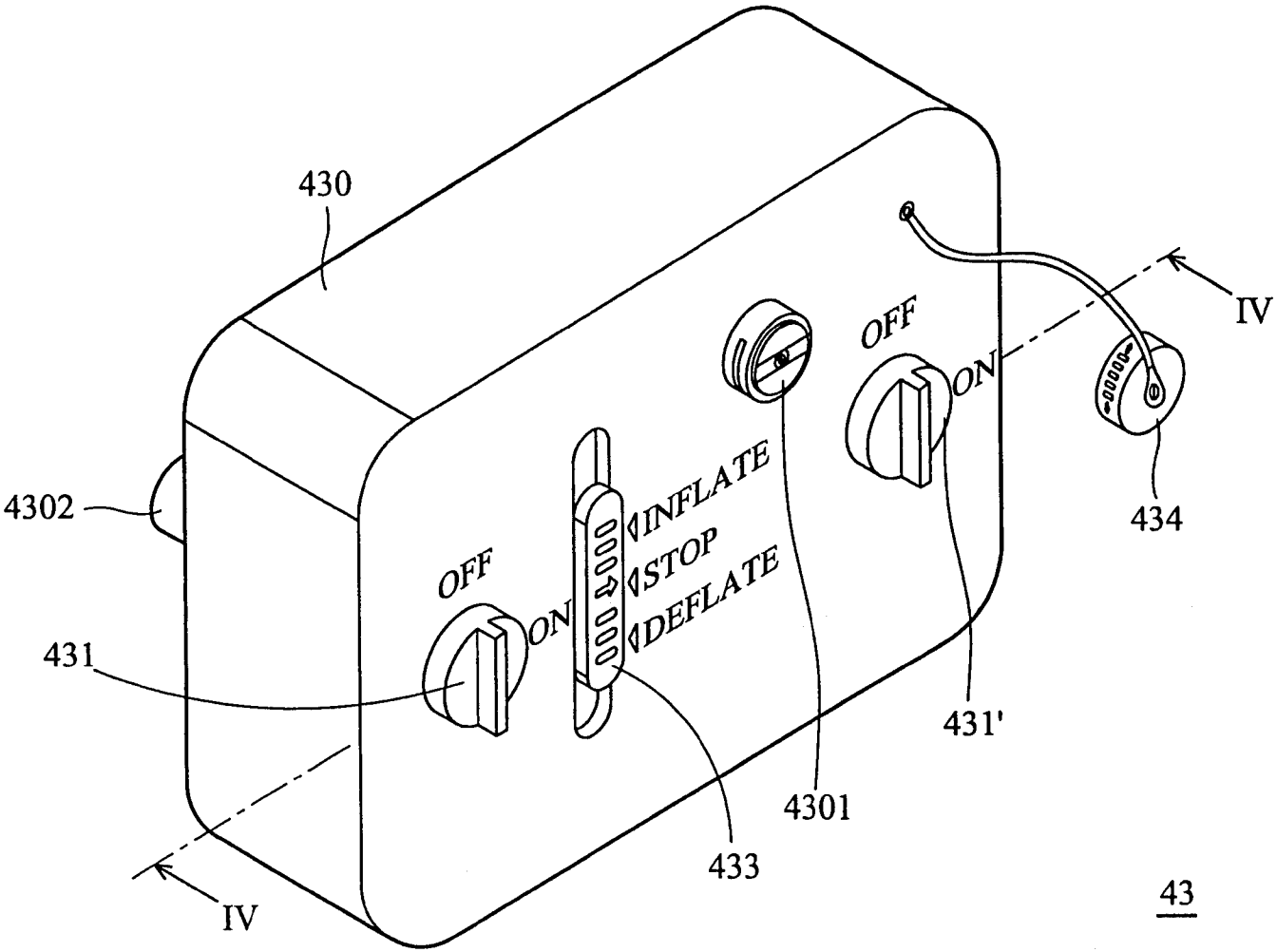
FIG. 4B is an expanded view of FIG. 4A.
Figure 4C:
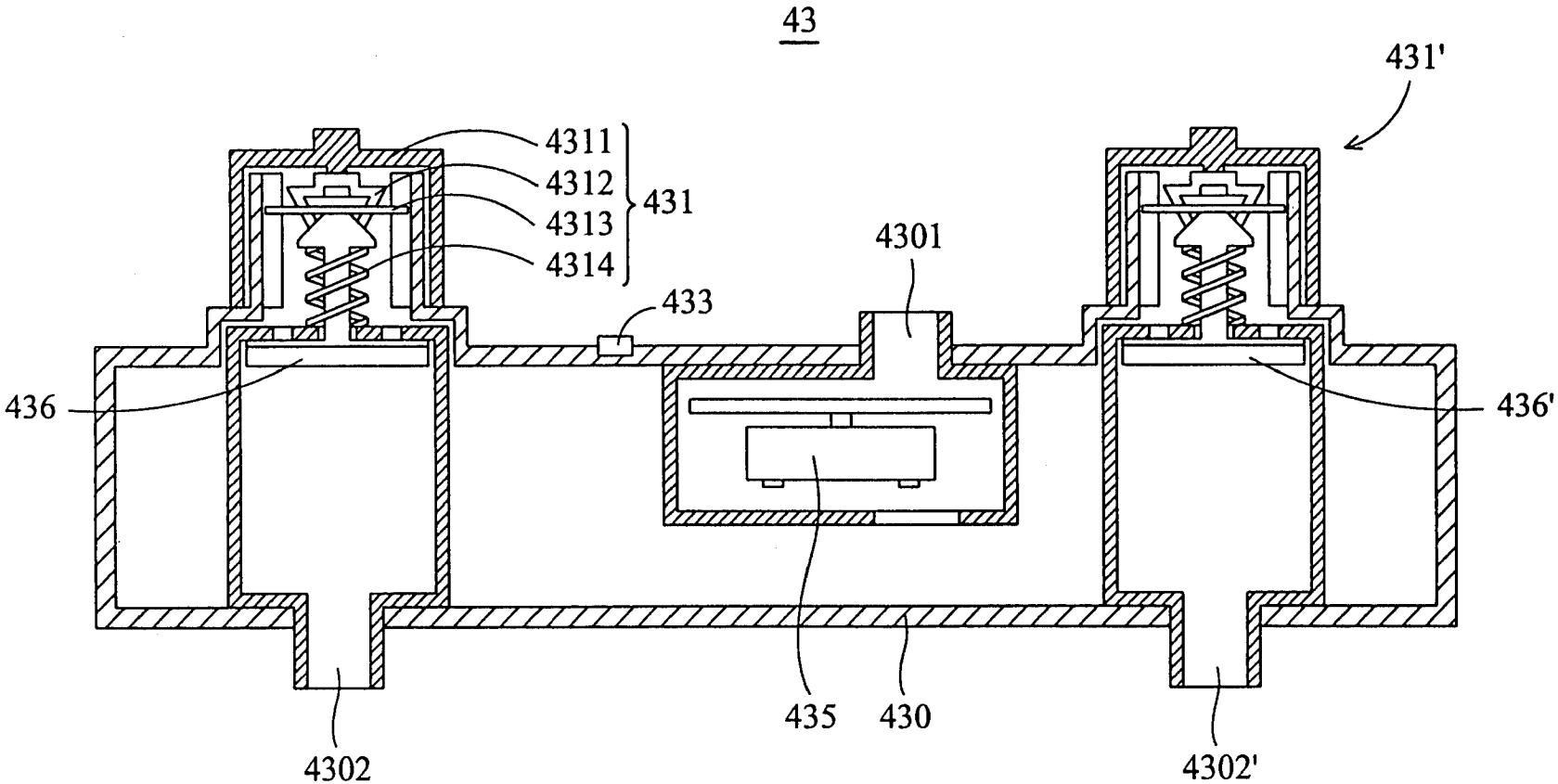
FIG. 4C is a sectional view of FIG. 4B along line IV-IV.
Figure 4E:
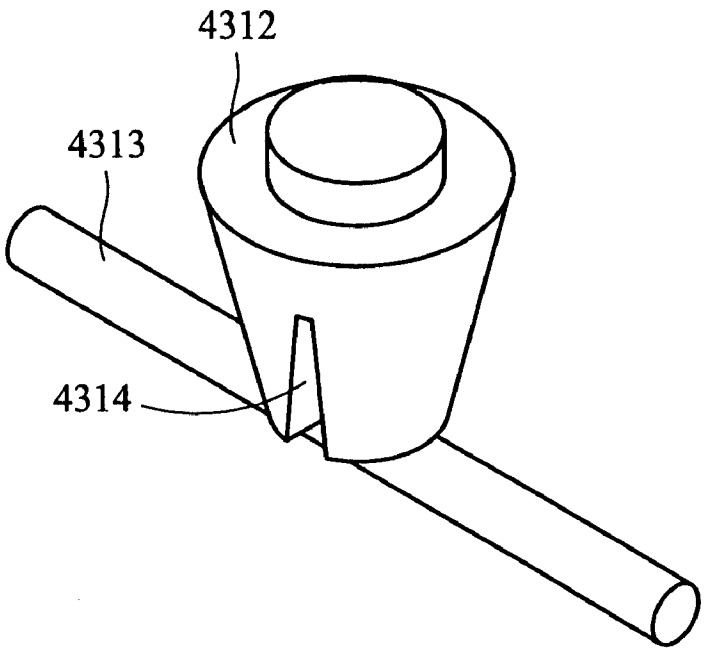
FIG. 4E is a schematic diagram of the cam element and bar of the valve switch of the fourth embodiment, where the valve switch is opened.
Figure 4D:
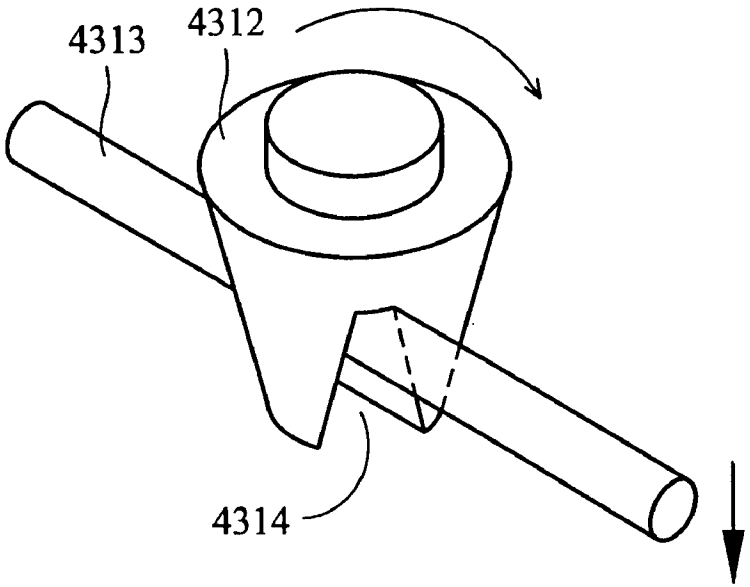
FIG. 4D is a schematic diagram of the cam element and bar of the valve switch of the fourth embodiment, where the valve switch is closed.

Referring to FIG. 4A, an inflatable product of a fourth embodiment of the present invention is an air mattress which includes a mattress pad 41, a back support 42 and an air pump assembly 43 built into the mattress pad 41 to inflate the mattress pad 41 and the back support 42. The back support 42 is inflated to raise the backrest of the mattress pad 41. Referring to FIGS. 4B and 4C, the air pump assembly 43 has a pack 430, a fan and motor 435 received in the pack 430, a motor switch 433 mounted on the pack 430 to activate the fan and motor 435, two valves 436, 436' disposed in the pack 430, and two valve switches 431, 431' for opening/closing the valves 436, 436'. The pack 430 has an air intake 4301, a first air outlet 4302 connected to the back support 42, and a second air outlet 4302' connected to the mattress pad 41. The valve switches 431, 431' have the same structure. Therefore, only the valve switch 431 is introduced and the description of the valve switch 431' is omitted. The valve switch 431 has a cap 4311, a cam element 4312, a bar 4313 and a spring 4314. The cam element 4312 is firmly connected to the cap 4311. When the cap 4311 is twisted, the cam element 4312 follows the cap 4311's rotation. Referring to FIG. 4D, the cam element 4312 has a recess 4314 on its bottom, via which the cam element 4312 sits on the bar 4313.

Figure 4F:
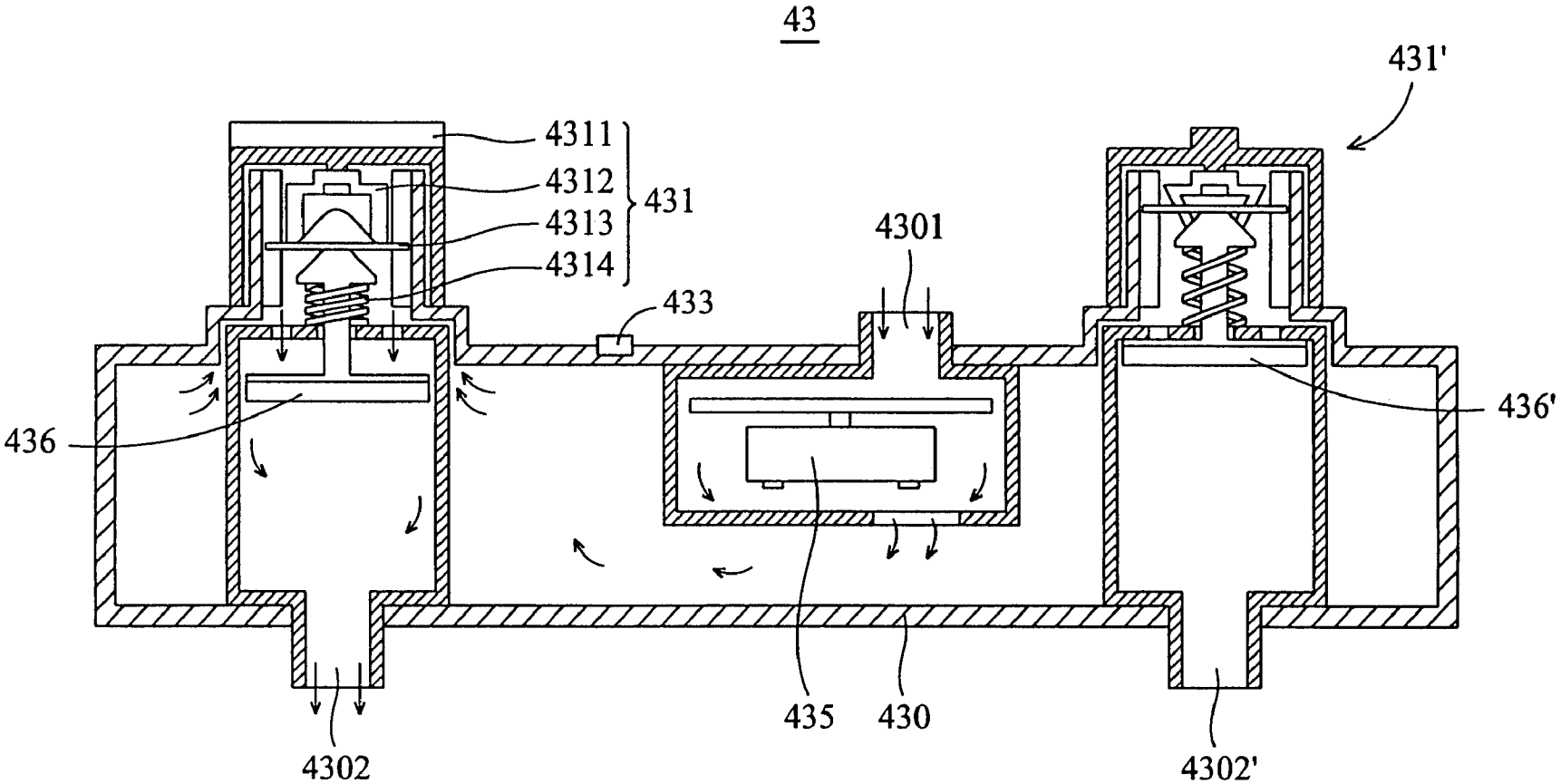
FIG. 4F depicts the air pump assembly of the fourth embodiment during inflation.

To inflate the back support 42, the user turns on the motor switch 433 to activate the fan and motor 435. In addition, the user turns on the valve switch 431 by twisting the cap 4311. The cam element 4312 follows the cap 4311's rotation as shown in FIG. 4D. Then, the bar 4313 is depressed by the cam element 4312 as shown in FIG. 4E. Referring to FIG. 4F, the spring 4314 is compressed by the bar 4313 and the valve 461 is opened. Then, outside air is pumped into the back support 42 through the air intake 4301 and air outlet 4302 of the air pump assembly 43. Arrows indicate the path of airflow.

If the user further turns on the valve switch 431', then the mattress pad 41 is inflated.

Figure 4G:
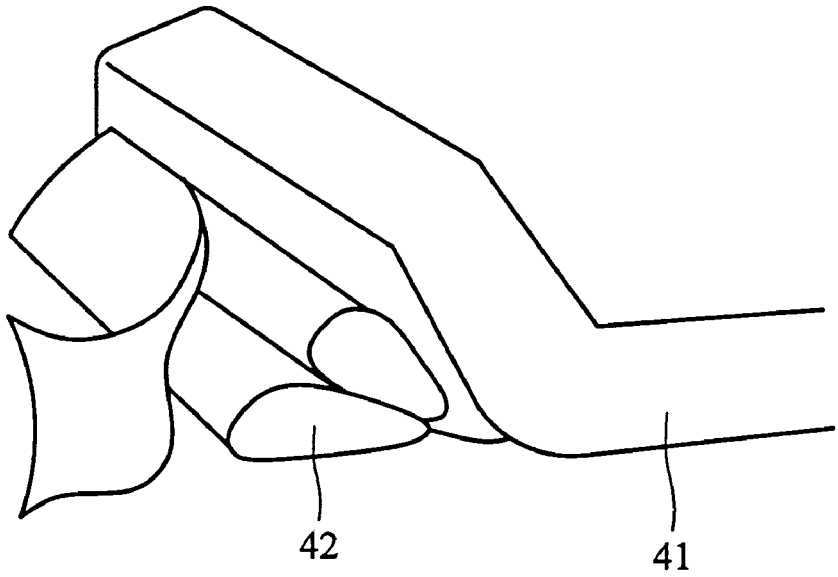
FIG. 4G depicts the back support of the air mattress of the fourth embodiment, wherein the back support is filled with air.
Figure 4H:
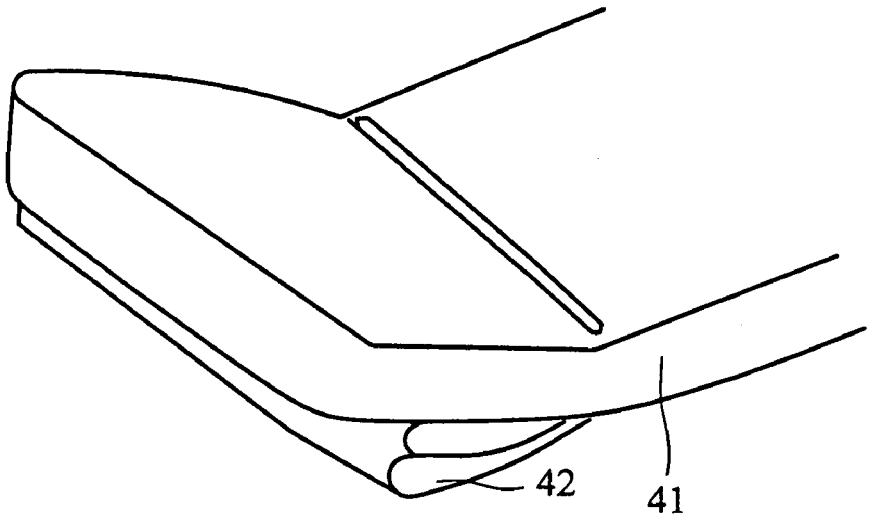
FIG. 4H depicts the deflated back support of the air mattress of FIG. 4G.

Referring to FIG. 4G, the back support 42 is inflated to raise the backrest of the mattress pad 41. Referring to FIG. 4H, the backrest of the mattress pad 41 is lowered when the back support 42 is deflated. It is noted that the cross section of the back support 42 is V-shaped. By such an arrangement, the mattress pad 41 is flat enough that a user cannot detect the presence of the deflated back support 42.

Figure 4I:
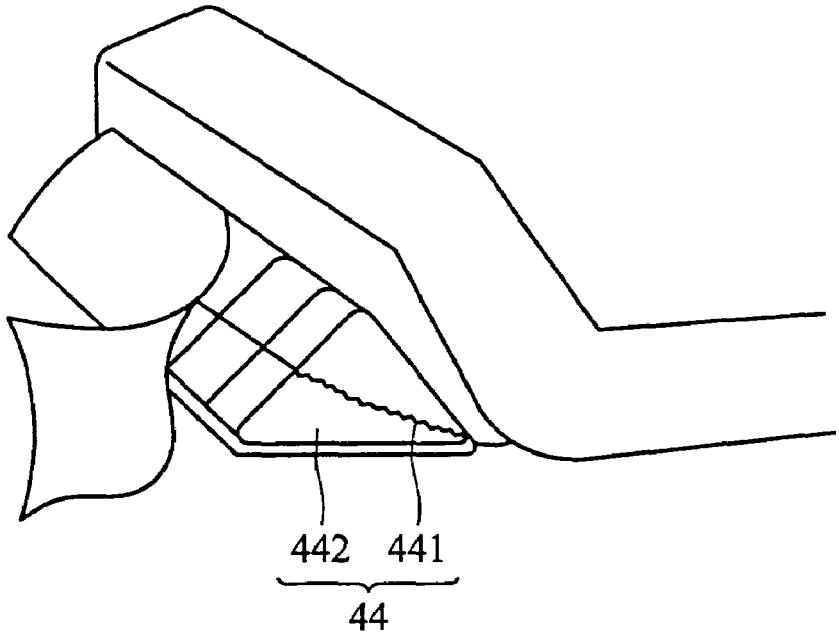
FIG. 4I depicts a modified example of the back support of the air mattress of the fourth embodiment, wherein the back support is filled with air.
Figure 4J:
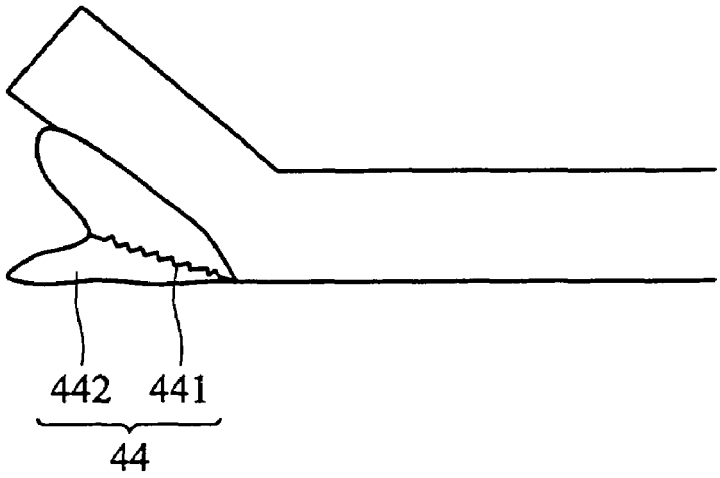
FIG. 4J depicts the deflated back support of the air mattress of FIG. 4I.

FIGS. 4I and 4J depict a modified example of the back support of the air mattress, wherein the back support 44 has a flexible chamber 442 of a triangular cross section and an elastic string 441 binding the chamber 442. When the chamber 442 is filled with the air, the elastic string 44 is stretched. When the chamber 442 is deflated, the elastic string 44 automatically contracts to collapse the chamber 442.

Figure 4K:
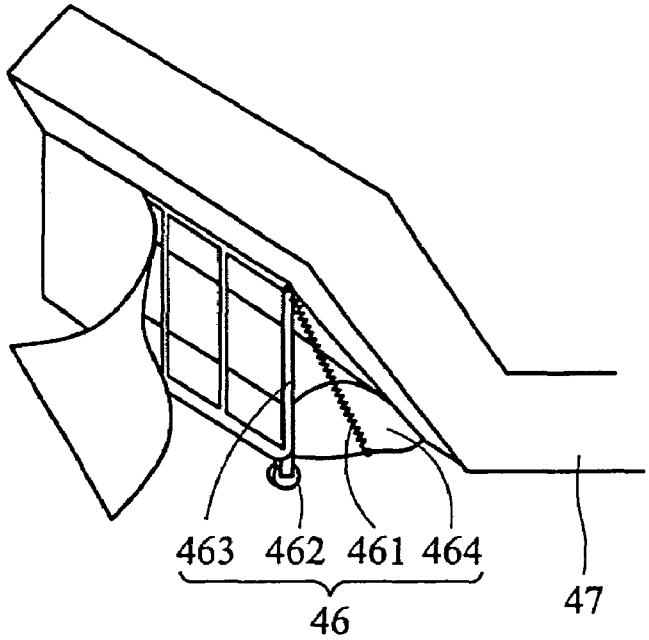
FIG. 4K depicts another modified example of the back support of the air mattress of the fourth embodiment, wherein the back support is filled with air.
Figure 4L:
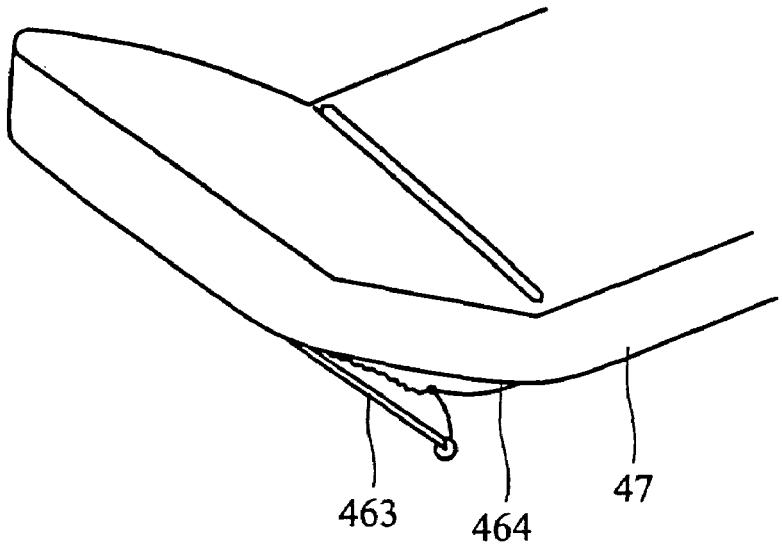
FIG. 4L depicts the deflated back support of the air mattress of FIG. 4K.

FIGS. 4K and 4L depict another modified example of the back support of the air mattress, wherein the back support 46 has a flexible chamber 464, a frame 463 pivoted to the mattress pad 47 and connected to the chamber 464, an elastic string 461 fixed to the frame 463 for binding the chamber 464, and round slider 462 mounted on the bottom of the frame 463. When the chamber 464 is filled with air, the elastic string 461 is stretched. When the chamber 464 is deflated, the elastic string 461 automatically contracts to collapse the chamber 464. Then, the chamber 464 pulls the frame 463. The frame 463 slides on the ground via the round sliders 462 and rotates toward the mattress pad 47 to collapse the chamber 464.

Figure 4M:
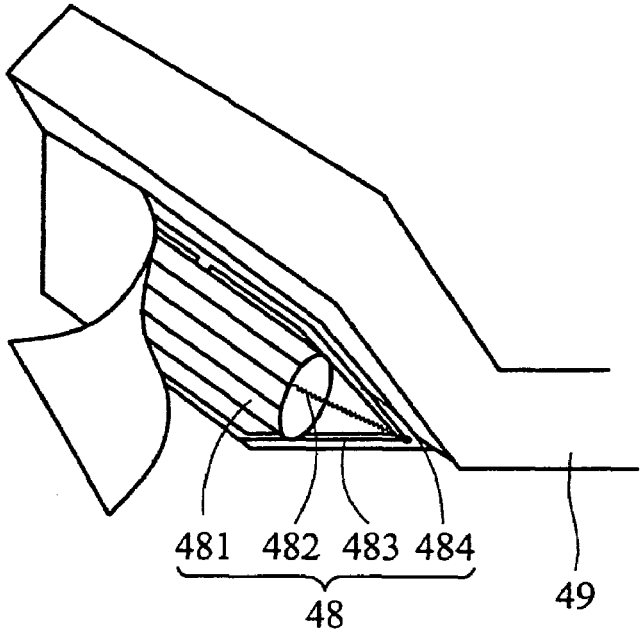
FIG. 4M depicts another modified example of the back support of the air mattress of the fourth embodiment, wherein the back support is filled with air.
Figure 4N:
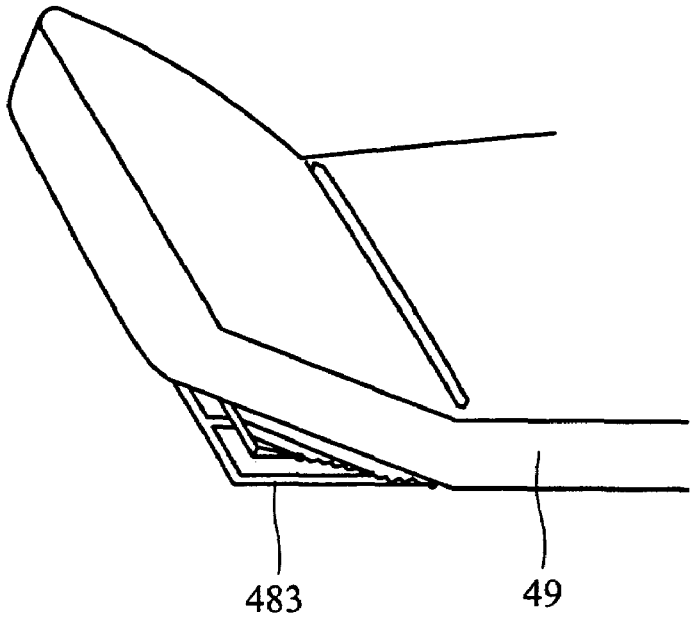
FIG. 4N depicts the deflated back support of the air mattress of FIG. 4M.

FIGS. 4M and 4N depict another modified example of the back support of the air mattress, wherein the back support 48 has a flexible chamber 481, a first frame 483, a second frame 484 hinged to the first frame 483, and an elastic string 482 fixed to the frames 483, 484 to bind the chamber 481. The flexible chamber 481 is sandwiched between the frames 483, 484. When the chamber 464 is filled with air, the elastic string 461 is stretched and the frames 483, 484 are spread. When the chamber 464 is deflated, the elastic string 461 automatically contracts to collapse the chamber 464. Also, the frames 483, 484 are closed to collapse the chamber 481.

Figure 5A:
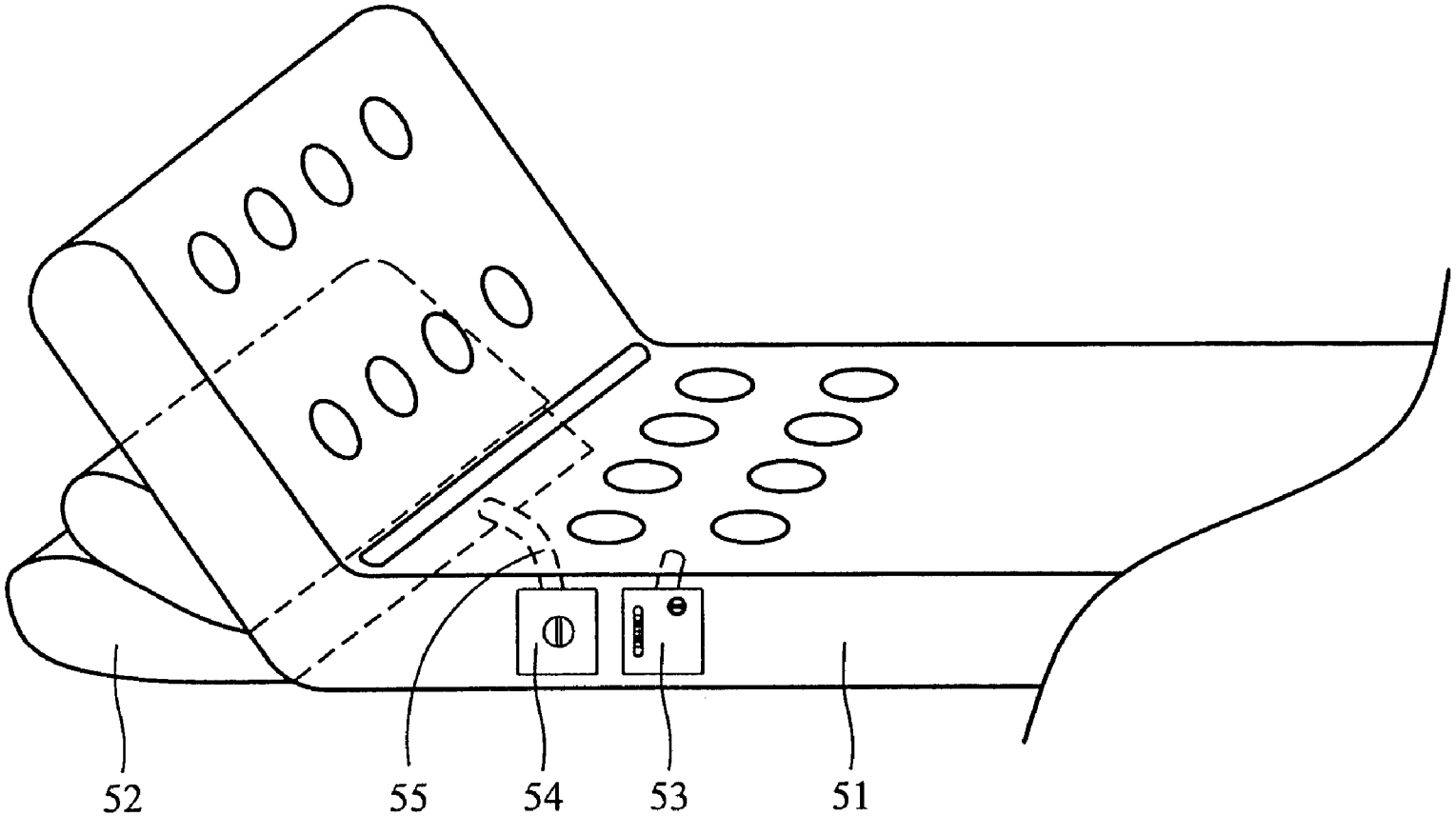
FIG. 5A is a perspective diagram of an inflatable product in accordance with a fifth embodiment of the present invention.
Figure 5B:
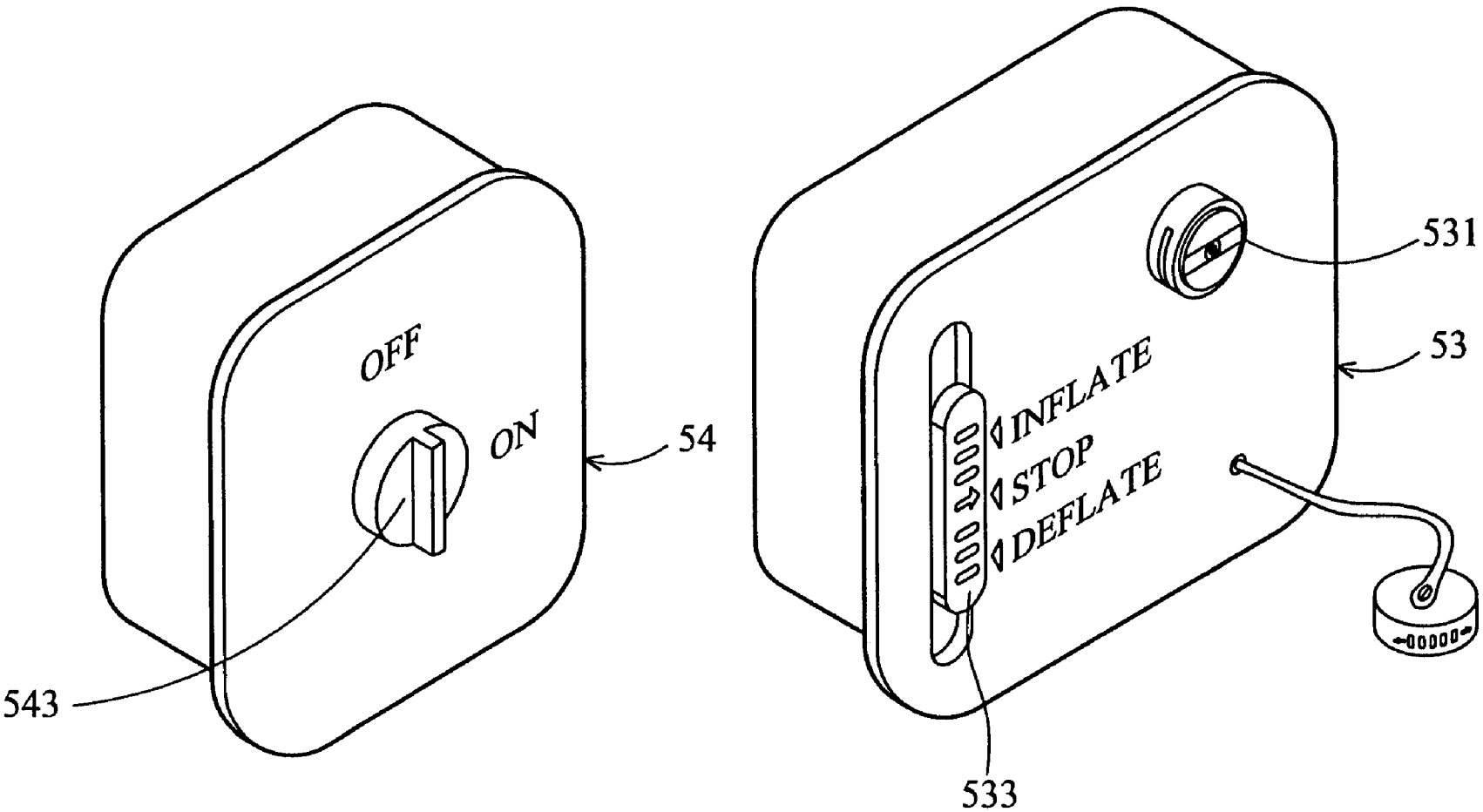
FIG. 5B is an expanded view of FIG. 5A.
Figure 5C:
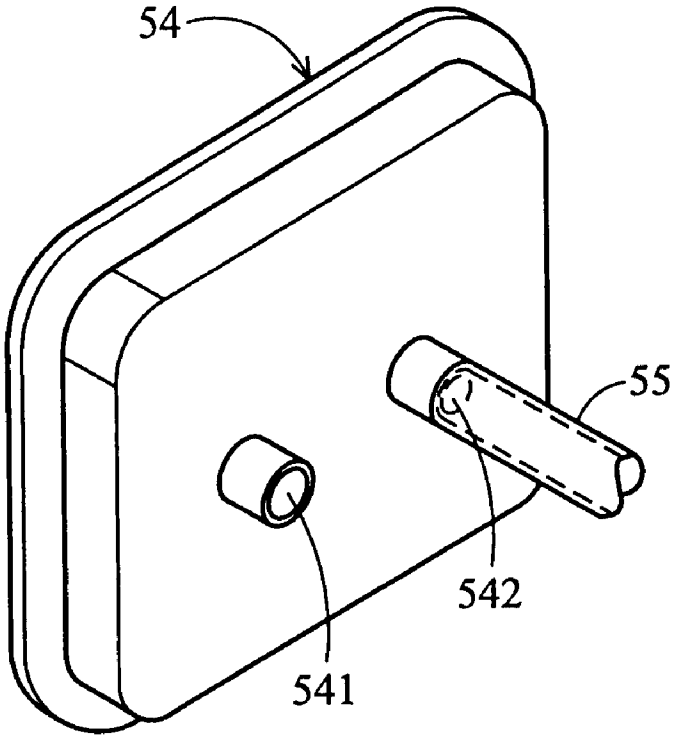
FIG. 5C is a back view of FIG. 5B.
Figure 5C:
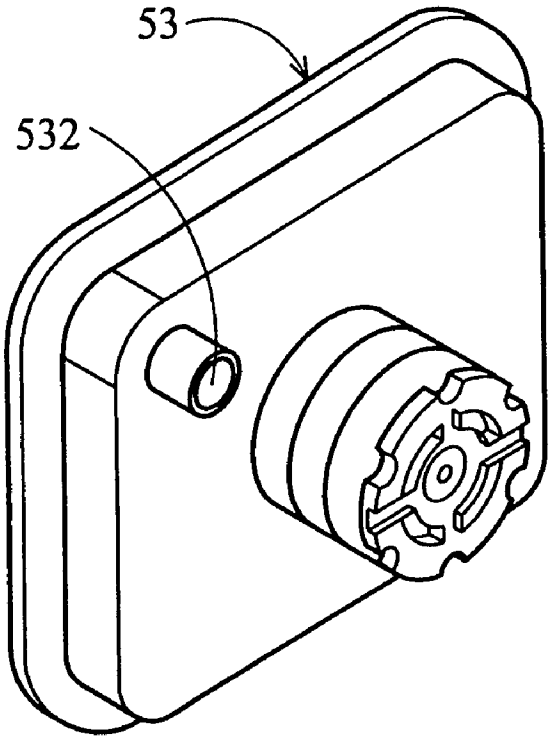

Referring to FIG. 5A, an inflatable product of a fifth embodiment of the present invention includes two inflatable chambers 51, 52, an air pump assembly 53 and a two-way valve device 54. The air pump assembly 43 is used to inflate the chambers 51 and 52 via the two-way valve device 54, wherein the two-way valve device 54 is connected to the chamber 52 via a pipe 55. Also referring to FIGS. 5B and 5C, the air pump assembly 53 has a motor switch 533 and an air intake 531 on its front surface, and an air outlet 532 on its rear surface. The two-way valve device 54 has a valve switch 543 on its front surface, an air intake 541 and an air outlet 542 on its rear surface. During inflation, the user turns on the motor switch 533 to pump air into the chamber 51 through the air intake 531 and air outlet 532. To further inflate the chamber 52, the valve switch 54 is turned on so that air in the chamber 51 flows into the chamber 52 through the two-way valve device 54.

Figure 6:
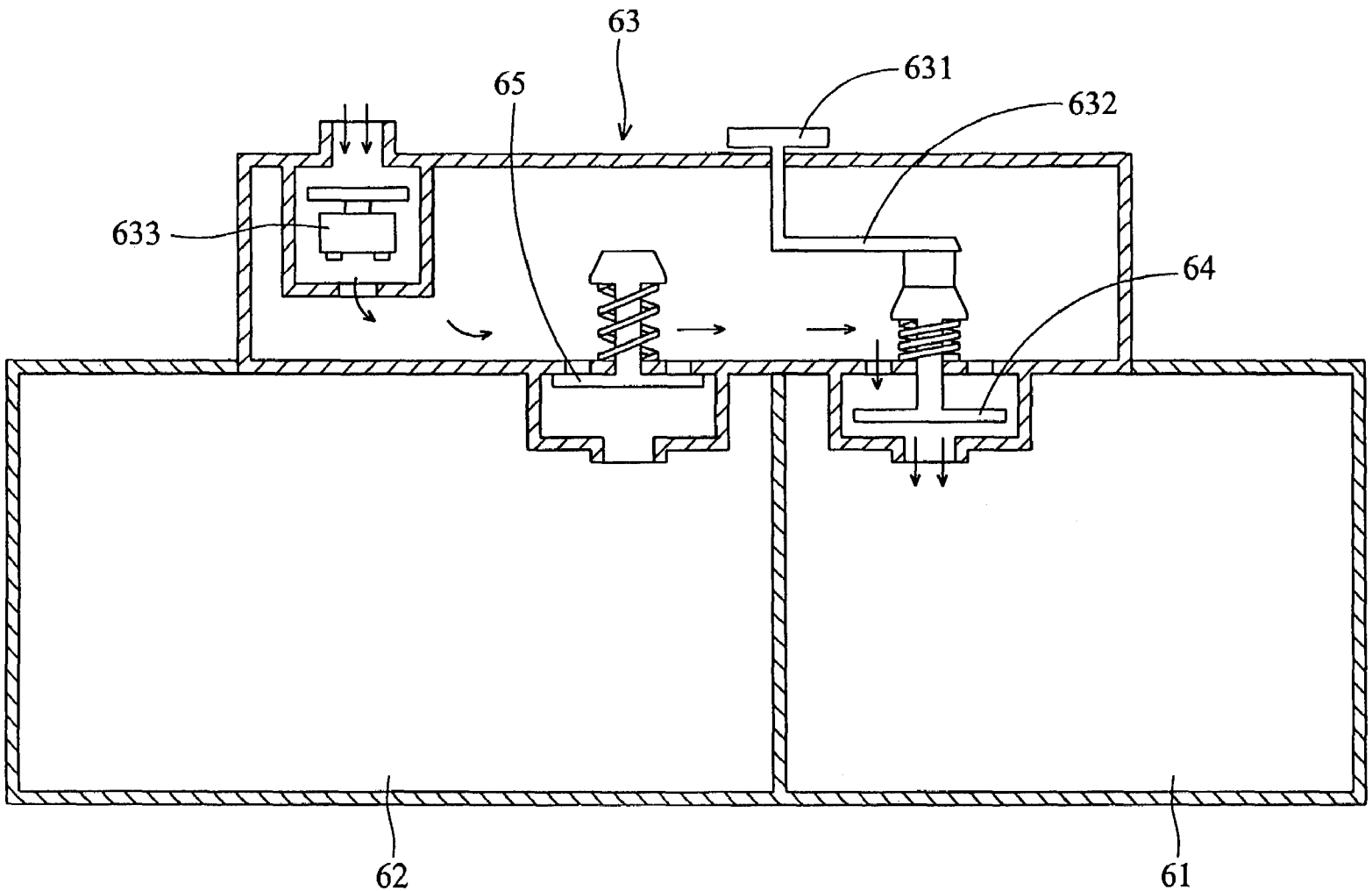
FIG. 6 depicts an inflatable product in accordance with a sixth embodiment of the present invention.

Referring to FIG. 6, an inflatable product of a sixth embodiment of the present invention includes two inflatable chambers 61, 62 and an air pump assembly 63. The air pump assembly 63 inflates the chambers 61, 62 via two check valves 64, 65, respectively. The air pump assembly 63 has a fan and motor 633, a valve switch 631 and a cantilever arm 632 connected to the valve switch 631. To inflate the chamber 61, the user twists the valve switch 631 so that the cantilever arm 632' depresses the valve 64. The valve 64 is thus opened. Arrows indicate the path of airflow. Similarly, the user twists the valve switch 631 to open the valve 65 by the cantilever arm 632, when the chamber 62 is inflated.

Figure 7A:
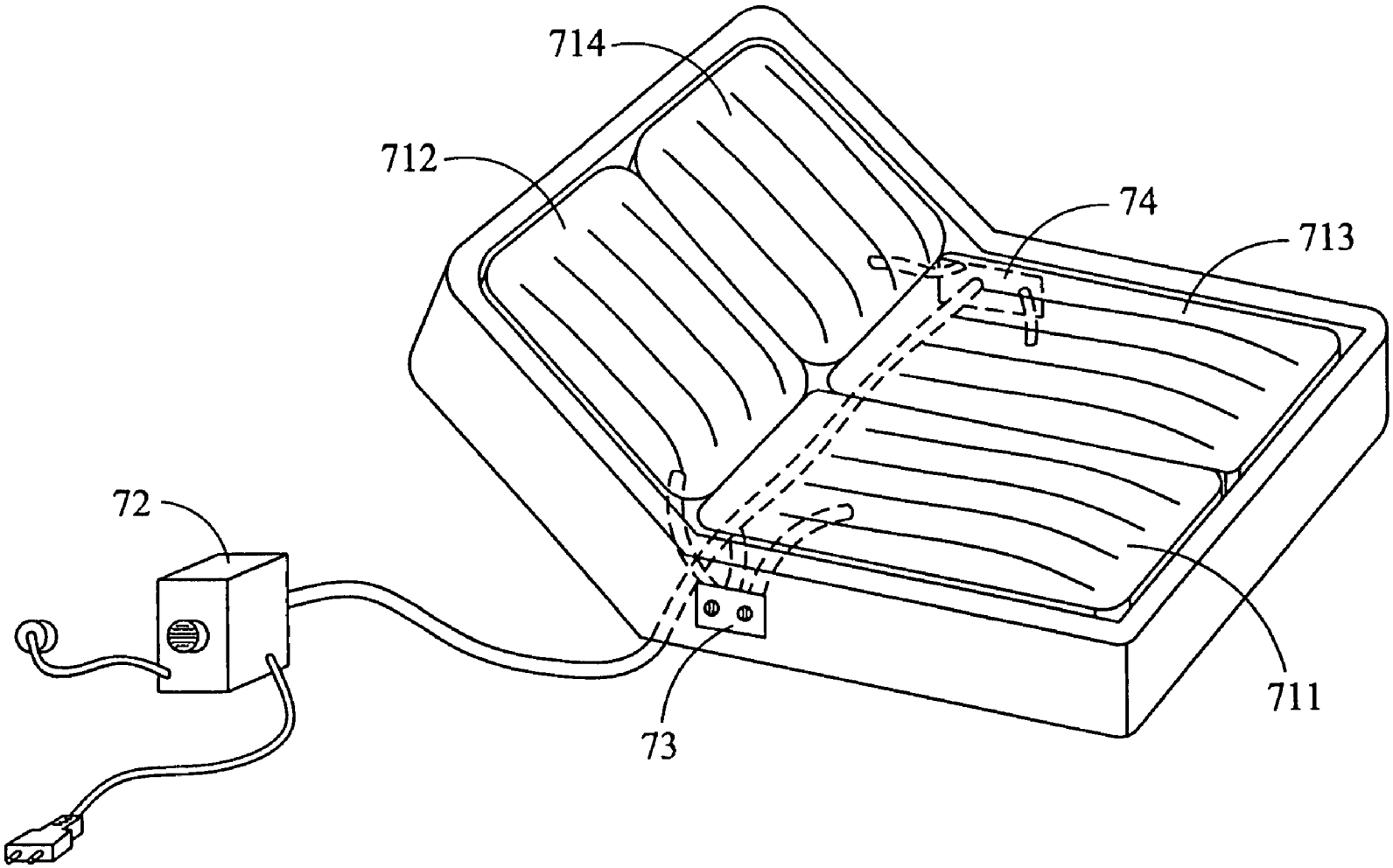
FIG. 7A depicts an inflatable product in accordance with a seventh embodiment of the present invention.
Figure 7B:
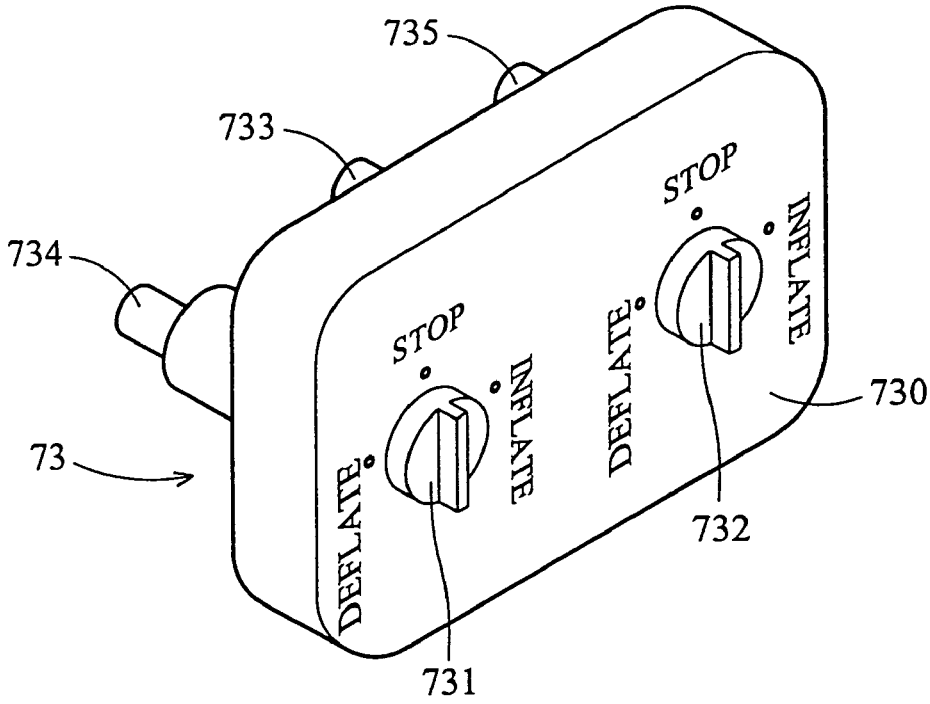
FIG. 7B depicts the first control pack of the inflatable product of FIG. 7A.
Figure 7C:
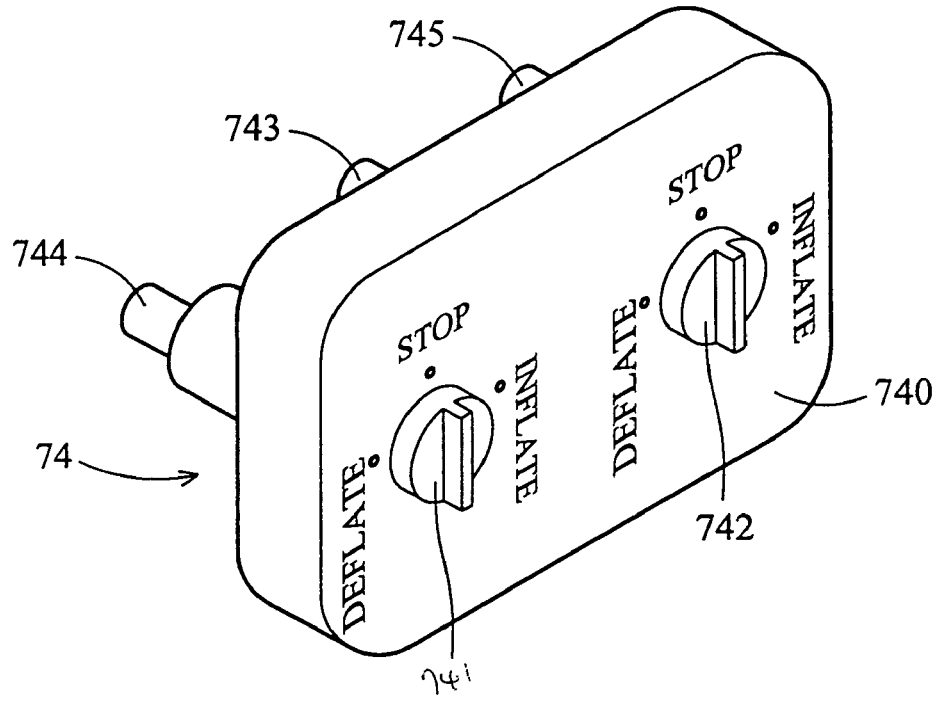
FIG. 7C depicts the second control pack of the inflatable product of FIG. 7A.
Figure 7D:
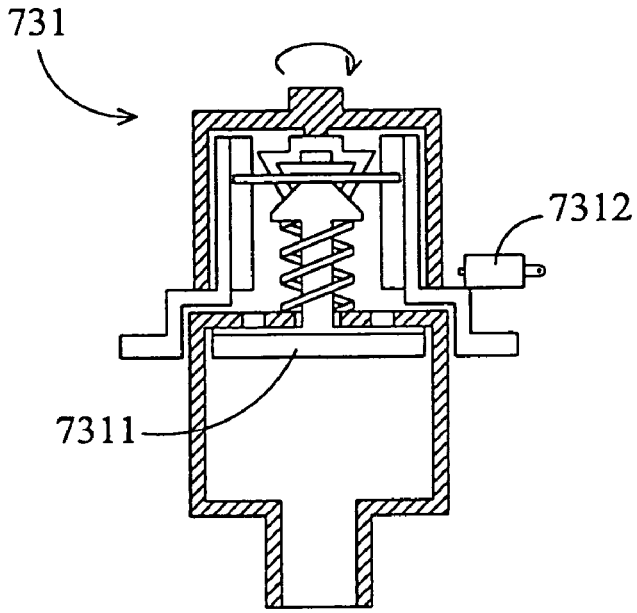
FIGS. 7D and 7E depict the operation of the switch of the first control pack of FIG. 7B.
Figure 7E:
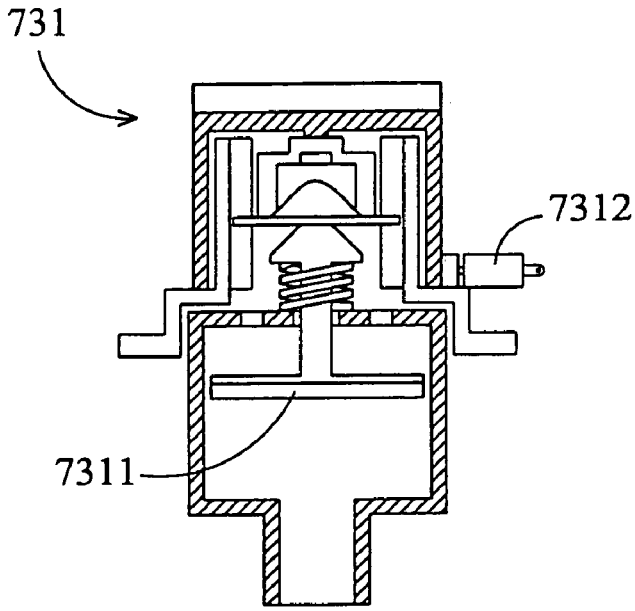

Referring to FIG. 7A, an inflatable product of a seventh embodiment of the present invention includes four inflatable chambers 711, 712, 713, 714, an air pump 72, a first control pack 73 for controlling the air pump 72 to inflate the chambers 711, 712, and a second control pack 74 for controlling the air pump 72 to inflate the chambers 713, 714. Referring to FIG. 7B, the first control pack 73 has a pack body 730, two switches 731, 732, an air intake 733 connected to the air pump 72 and two air outlets 734, 735 respectively connected to the chambers 712, 711. Referring to FIG. 7C, the second control pack 74 has the same structure as the first control pack 73. The second control pack 74 has a pack body 740, two switches 741, 742, an air intake 743 connected to the air pump 72 and two air outlets 744, 745 respectively connected to the chambers 713, 714. Referring to FIGS. 7D, the switch 731 is connected to a valve 7311 while a micro switch 7312 is provided beside the switch 731. When the switch 731 is rotated to the "INFLATE" position, the valve 7311 is opened and the micro switch 7312 is turned on as shown in FIG. 7E. Other switches 732, 741, 742 have the same structure as the switch 731, thereby having micro switches beside. Further referring to FIG. 7F, when any of the micro switches 7312, 7322, 7412, 7422 is turned on, a relay 75 is activated and turned on. Then, the air pump 72 is supplied with power to inflate the corresponding chambers 711, 712, 713, 714.

Figure 7F:
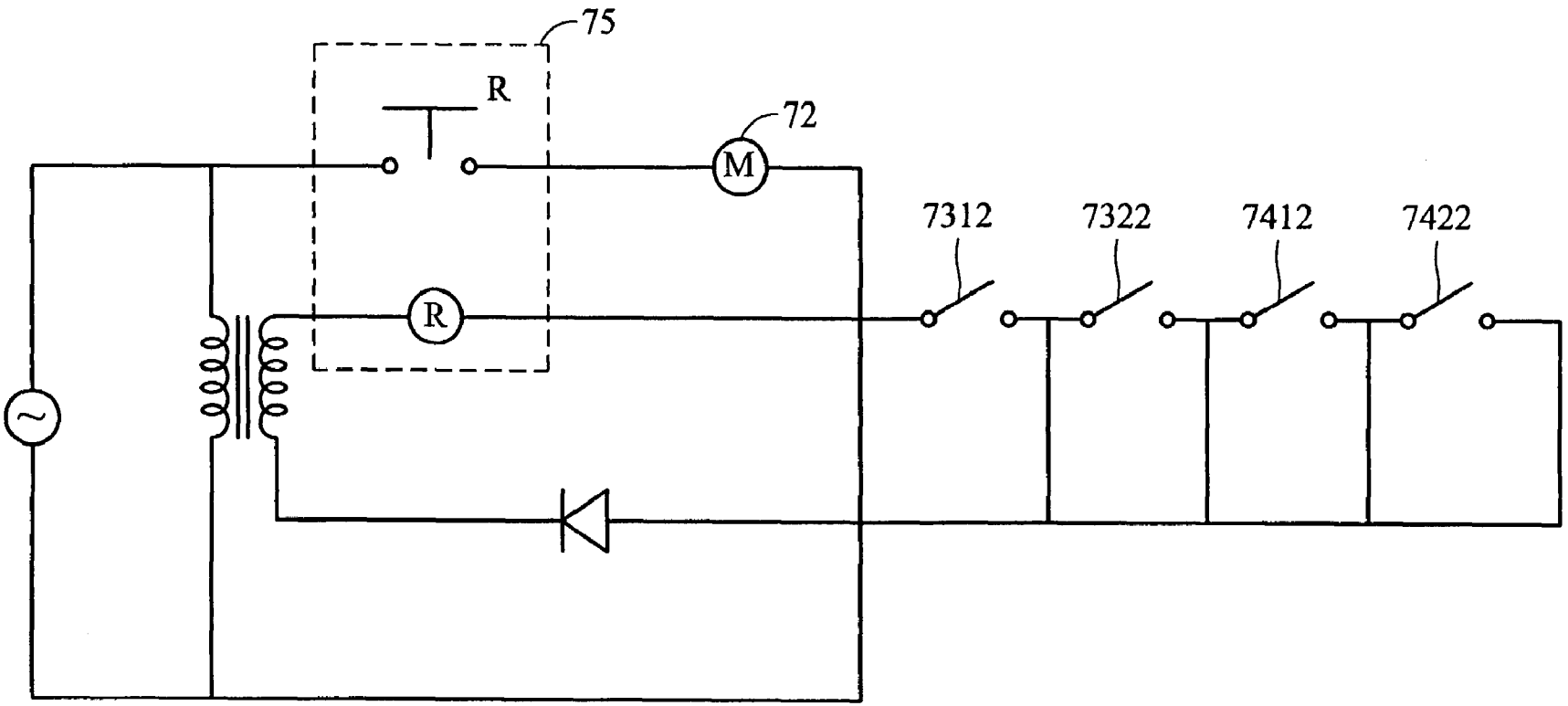
FIG. 7F depicts a control circuit for activating the air pump of FIG. 7A.
Figure 7G:
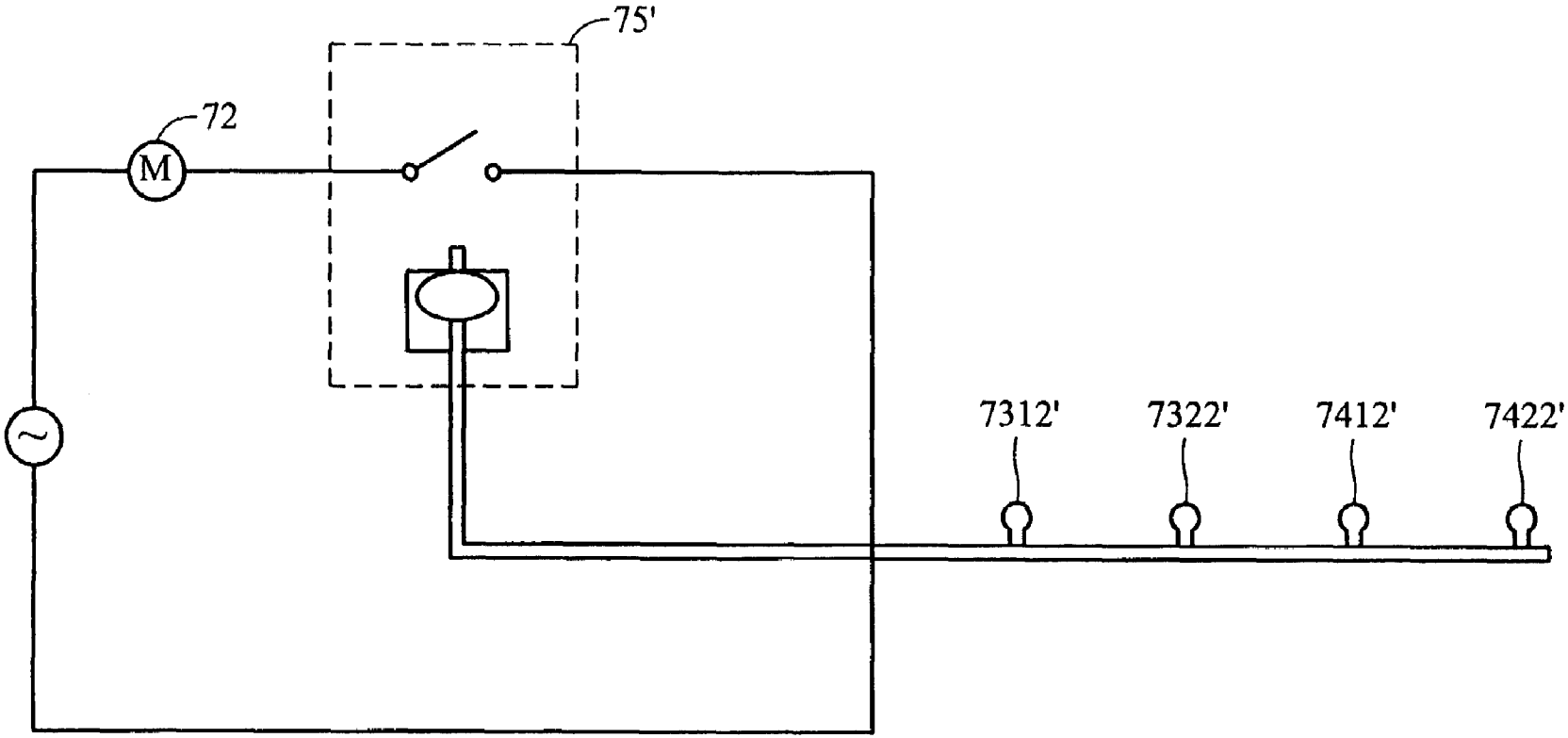
FIG. 7G depicts a modified control circuit of FIG. 7F.

FIG. 7G depicts a modified control circuit of FIG. 7F, wherein reference numerals 7312', 7322', 7412', 7422' represent air bulbs instead of micro switches. When any of the air bulbs 7312', 7322', 7412', 7422' is pressed, a pressure switch 75' is turned on. Then, the air pump 72 is supplied with power to inflate the corresponding chambers 711, 712, 713, 714.

Figure 8A:
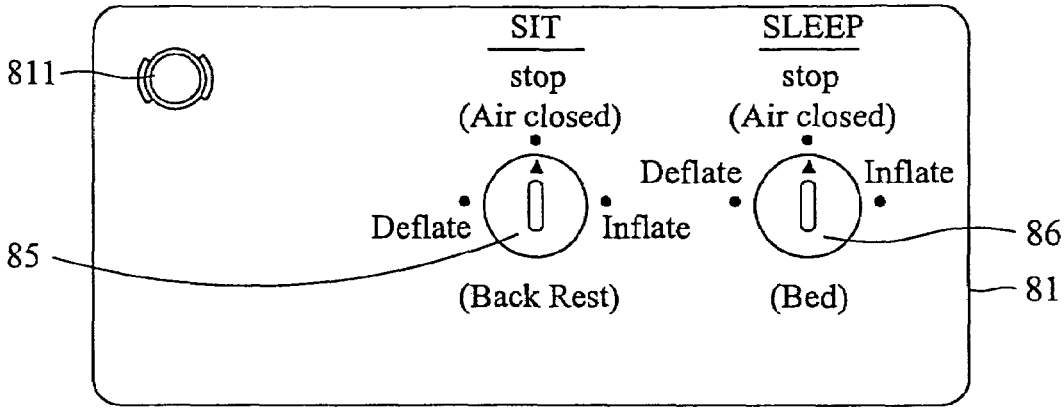
FIG. 8A is a front view of the operating panel of the air pump assembly in accordance with an eighth embodiment of the present invention.
Figure 8B:
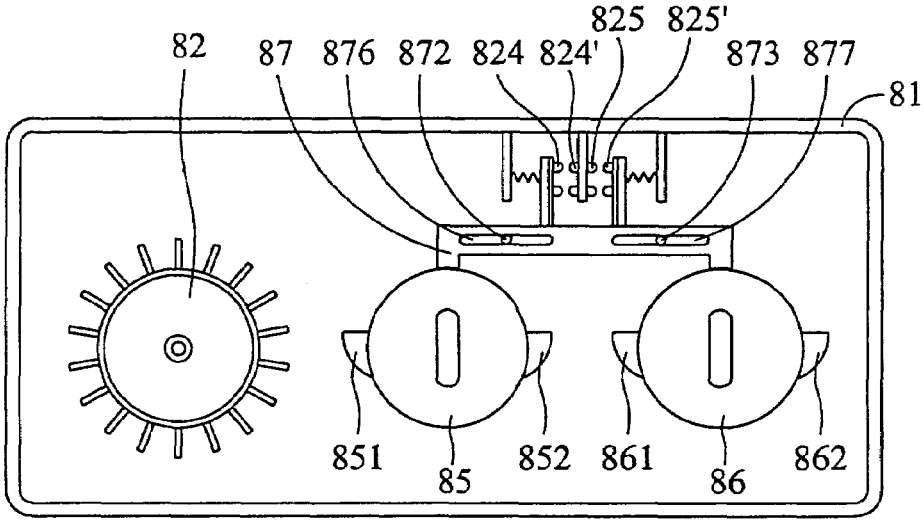
FIG. 8B is the front view of the air pump assembly of FIG. 8A, with the operating panel removed.
Figure 8C:
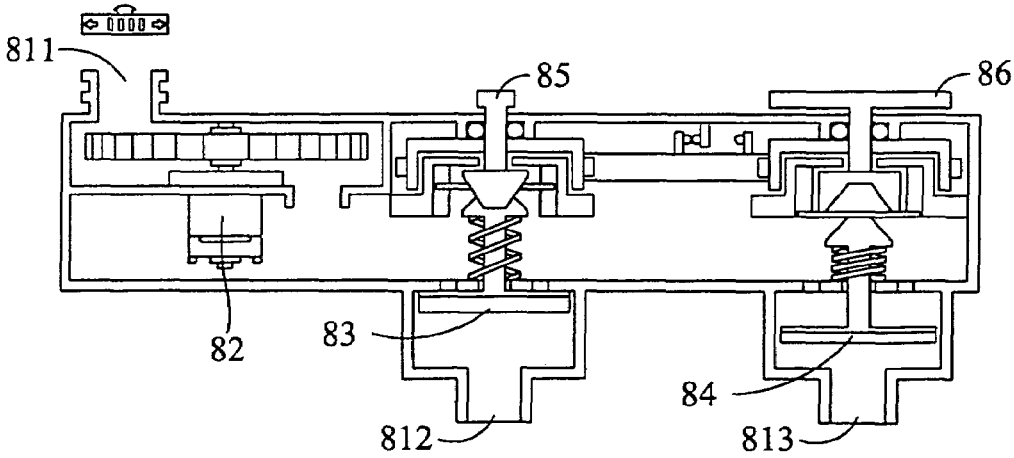
FIG. 8C is a bottom view of FIG. 8C.

FIGS. 8A, 8B and 8C show an air pump assembly in accordance with an eighth embodiment of the present invention, wherein FIG. 8A is the front view of the operating panel of the air pump assembly, FIG. 8B is the front view of the air pump with the operating panel removed, and FIG. 8D is a bottom view of FIG. 8C. The air pump assembly includes a pack 81 with a vent 811 on its top and two vents 812, 813 on its bottom, a fan and motor 82 received in the pack 81, two valves 83, 84 for opening/closing the vents 812 and 813, two switches 85, 86 and an elongated slider 87 provided beside the switches 85, 86. The elongated slider 87 has two slots 876, 877 with pins 872, 873 received inside, while the pins 872, 873 are firmly fixed in the pack 81. By the arrangement, the slider 87 is slideable with respect to the pins 872, 873. Furthermore, the fan and motor 82 have two pairs of electrodes 824, 824' and 825, 825'. The electrodes 824', 825 are fixed to the pack 81, while the electrodes 824, 825' are firmly connected to the slider 87. When the slider 87 is moved to the right, the pair of electrodes 824, 824' physically contact each other. Then, the fan and motor 82 is activated to rotate in a normal direction. When the slider 87 is moved to the left, the pair of electrodes 825, 825' physically contact each other. Then, the fan and motor 82 is activated to rotate in a reverse direction. Furthermore, the switches 85, 86 have ears 851, 852, 861, 862 to push the slider 87 in different directions.

During inflation, the switch 85, for example, is rotated to "INFLATE". The valve 83 connected to the switch 85 is opened. Meanwhile, the ear 851 of the switch 85 pushes against the slider 87 so that the pair of electrodes 824, 824' physically contact each other. Thus, the fan and motor 82 is activated to pump air from the top vent 811 to the bottom vent 812. When the switch 85 is rotated to "DEFLATE", the valve 83 is opened. The ear 852 of the switch 85 pushes against the lever 871 so that the pair of electrodes 825, 825' contact each other and the pair of electrodes 824, 824' separate. Then, the fan and motor 82 operates in reverse to pump air from the bottom vent 812 to the top vent 811. Similarly, air is pumped from the top vent 811 to the bottom vent 813 when the switch 86 is rotated to "INFLATE". On the other hand, air is pumped from the bottom vent 813 to the top vent 811 when the switch 86 is rotated to "DEFLATE".

Figure 9A:
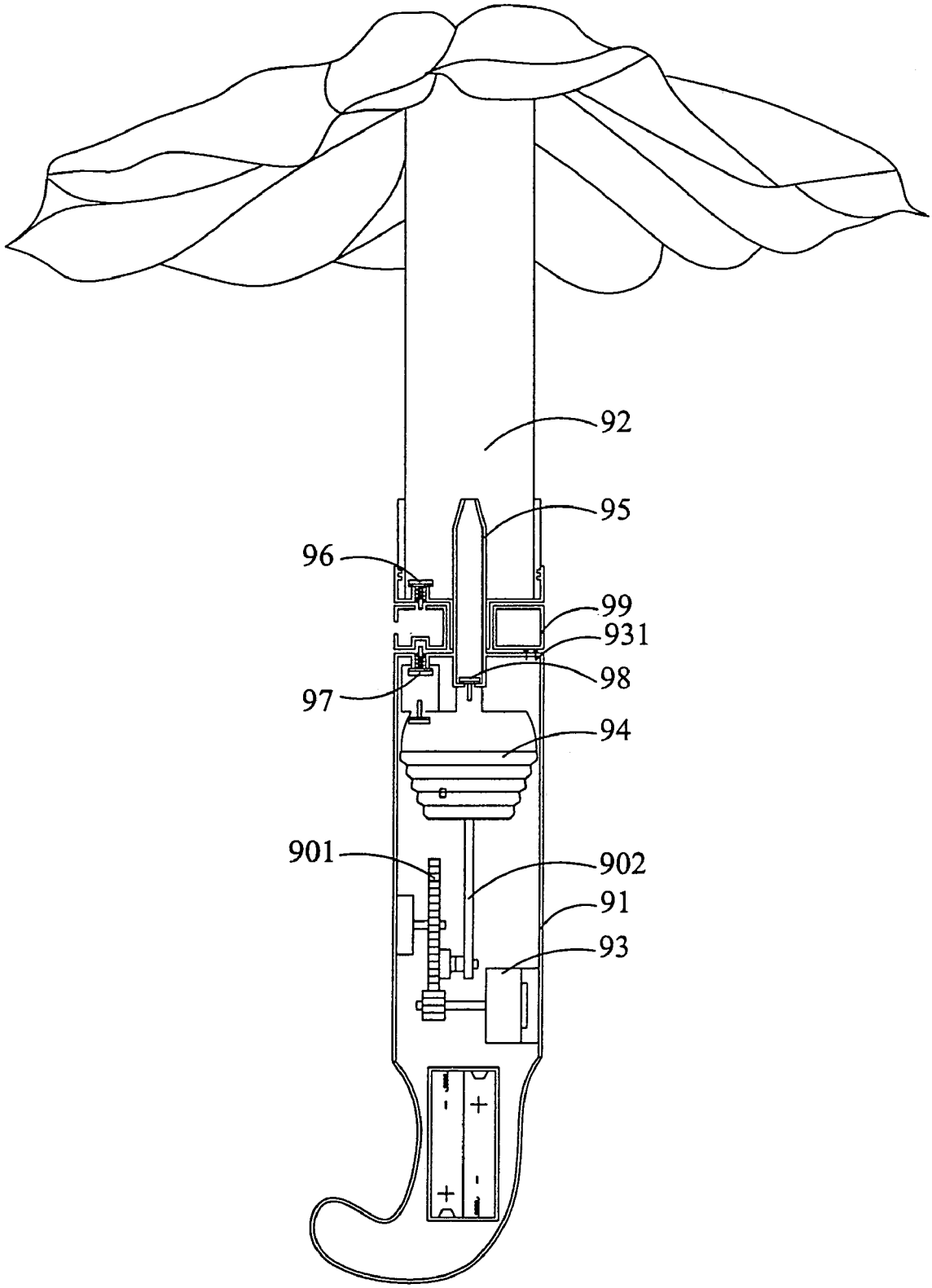
FIG. 9A depicts an inflatable product of a ninth embodiment of the present invention.

Referring to FIG. 9A, an inflatable product of a ninth embodiment of the present invention is an umbrella. The umbrella has a stiff handle 91 and an inflatable (flexible) shank 92. An air pump is arranged in the handle 91 to pump the inflatable shank 92. The air pump has a nozzle 95, bellows 94 for supplying the shank 92 with air via the nozzle 95, and a motor 93 for operating the bellows 94 via gears 901 and a link 902. Furthermore, a ring switch 99 is provided around the handle 91 to activate the motor 93. In addition, three check valves 96, 97, 98 are provided to control the airflow. The first check valve 97 for controlling the entrance of air into the bellows 94 is provided under the ring switch 99. The second check valve 96 for controlling the exit of air from the inflatable shank 92 is provided over the ring switch 99. The third check valve 98 is provided between the bellows 94 and the nozzle 95 for controlling the airflow from the bellows 94 to the shank 92.

Figure 9B:
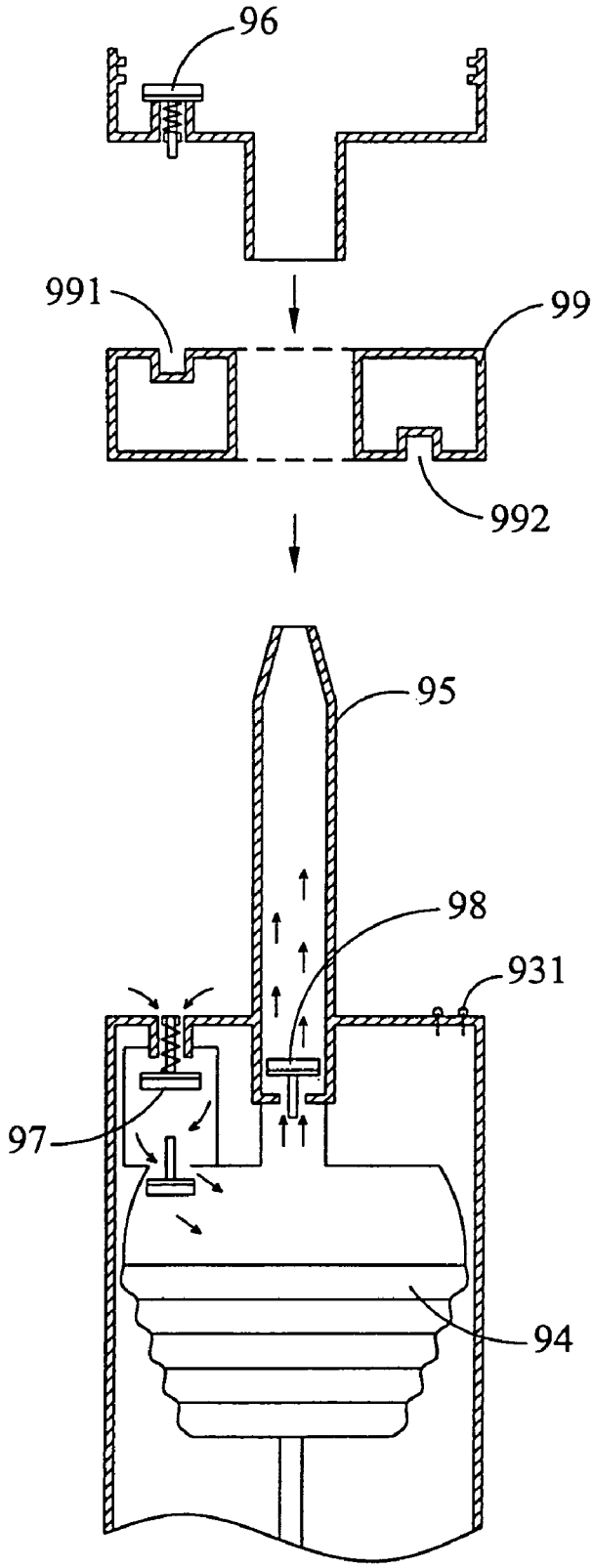
FIG. 9B is an expanded view of the inflatable product of FIG. 9A, during inflation.

On the top and bottom of the ring switch 99 are provided a plurality of recesses. Referring to FIG. 9B, During inflation, the ring switch 99 is rotated to such a position that a top recess 991 of the ring switch 99 is positioned under the check valve 96, allowing the check valve 96 to be closed. Meanwhile, the check valve 97 is opened by the bottom of the ring switch 99. Also, a bottom recess 992 of the ring switch 99 is positioned over the button 931 of the motor 93 to release the button 931. Then, the motor 93 operates the bellows 94 via the gears 901 and link 902. Outside air is pumped into the shank 92 through the check valves 97, 98. The path of airflow is indicated by arrows.

Figure 9C:
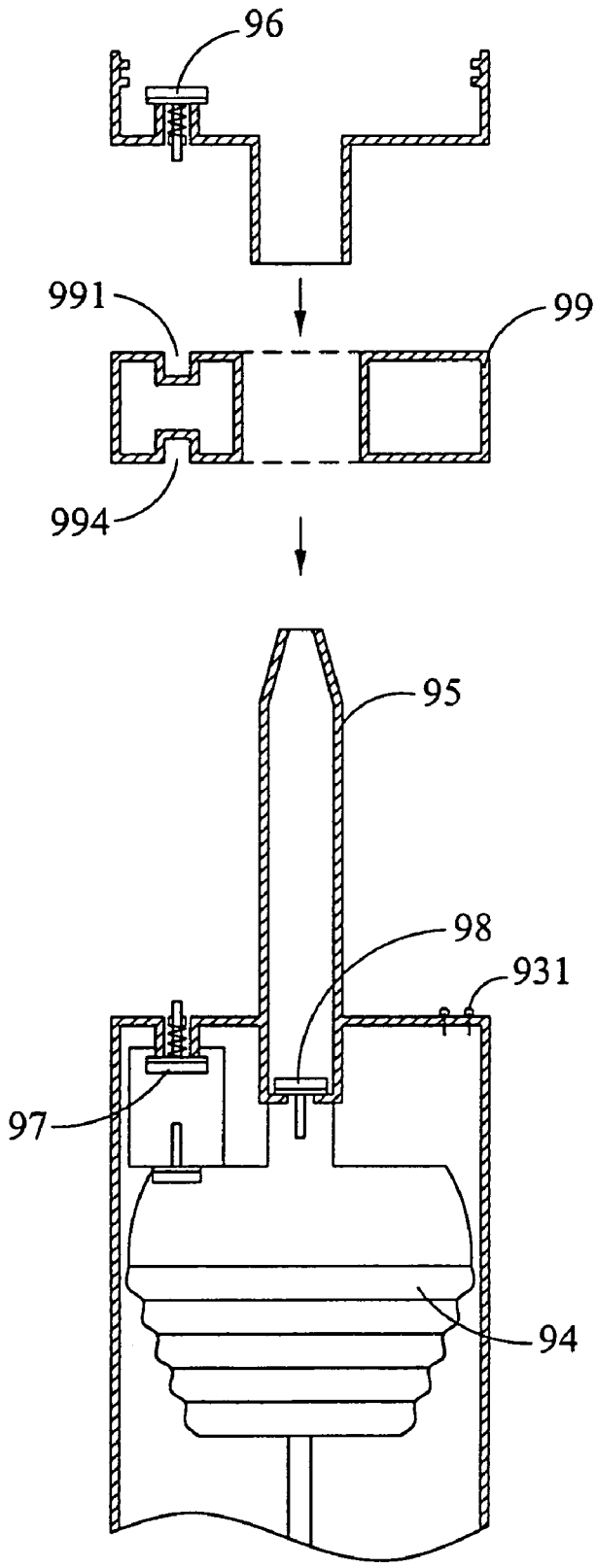
FIG. 9C is an expanded view of the inflatable product of FIG. 9A, in stop mode.

To stop the inflating operation, the user rotates the ring switch 99 to the position shown in FIG. 9C, wherein the top recess 991 of the ring switch 99 is still positioned under the check valve 96 so that the check valve 96 is closed. Another bottom recess 994 of the ring switch 99 is positioned over the check valve 97 so that the check valve 97 is closed. Also, the bottom of the ring switch 99 pushes the button 931 to stop the motor 93.

Figure 9D:
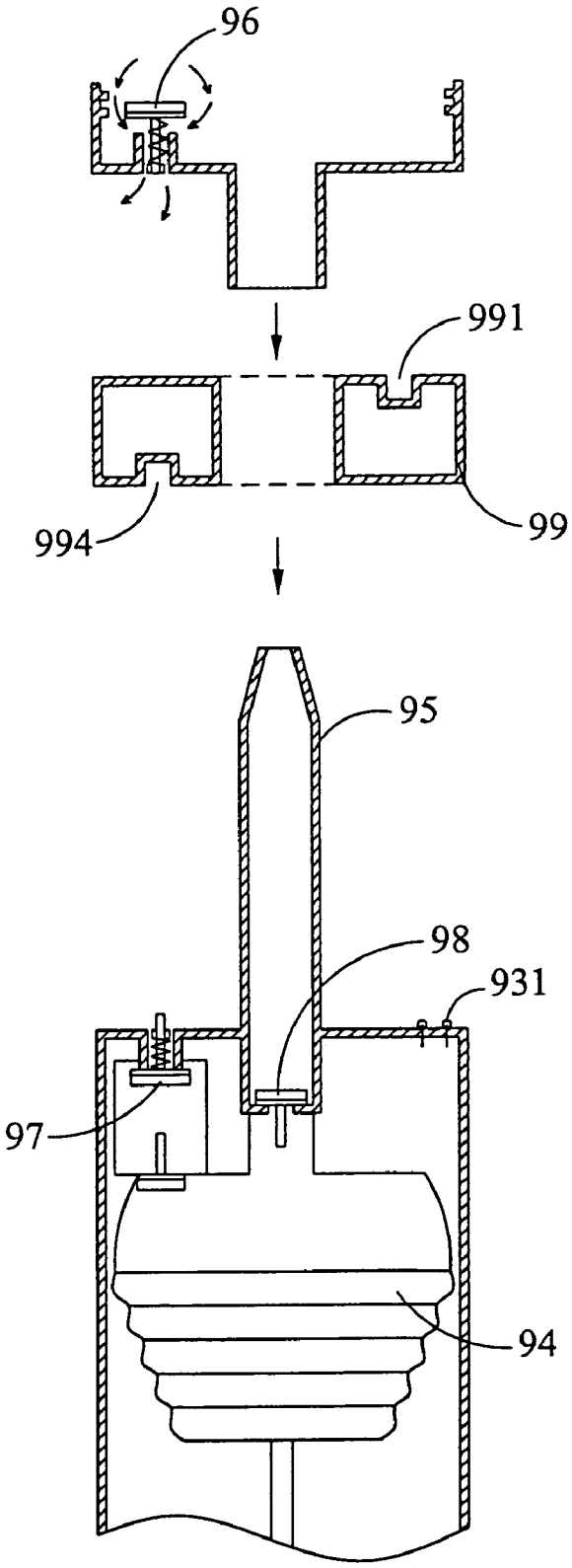
FIG. 9D is an expanded view of the inflatable product of FIG. 9A, during deflation.

To deflate the umbrella, the user rotates the ring switch 99 to the position shown in FIG. 9D, wherein the bottom recess 994 of the ring switch 99 is still positioned over the check valve 97 so that the check valve 97 is closed. The bottom of the ring switch 99 continues pushing the button 931 so that the motor 93 is still at rest. The top of the ring switch 99 pushes the check valve 96 so that the check valve 96 is opened. Then, air in the shank 92 of the umbrella automatically flows out through the check valve 96.

Figure 10A:
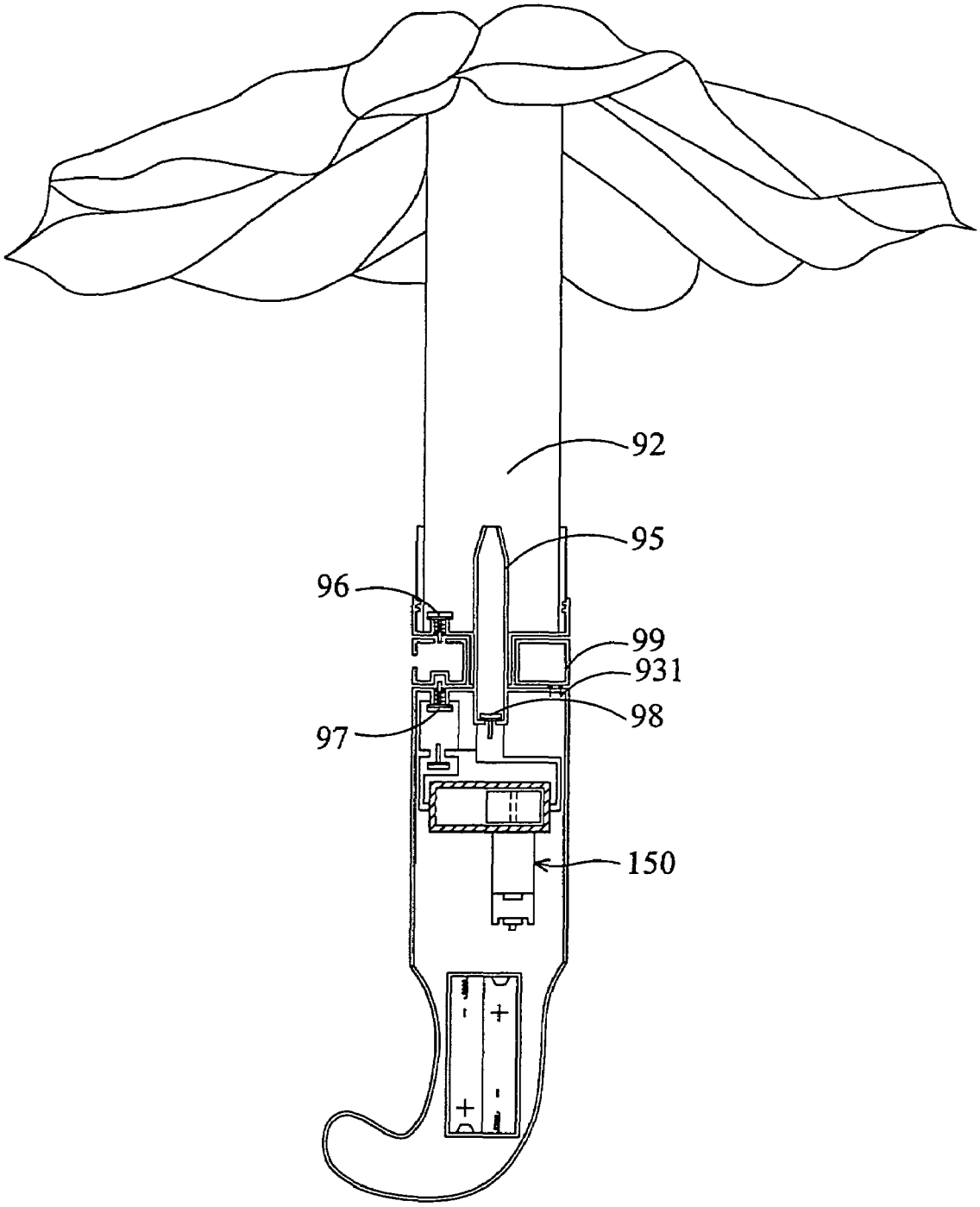
FIG. 10A shows a modified inflatable umbrella of the ninth embodiment of the present invention.
Figure 10B:
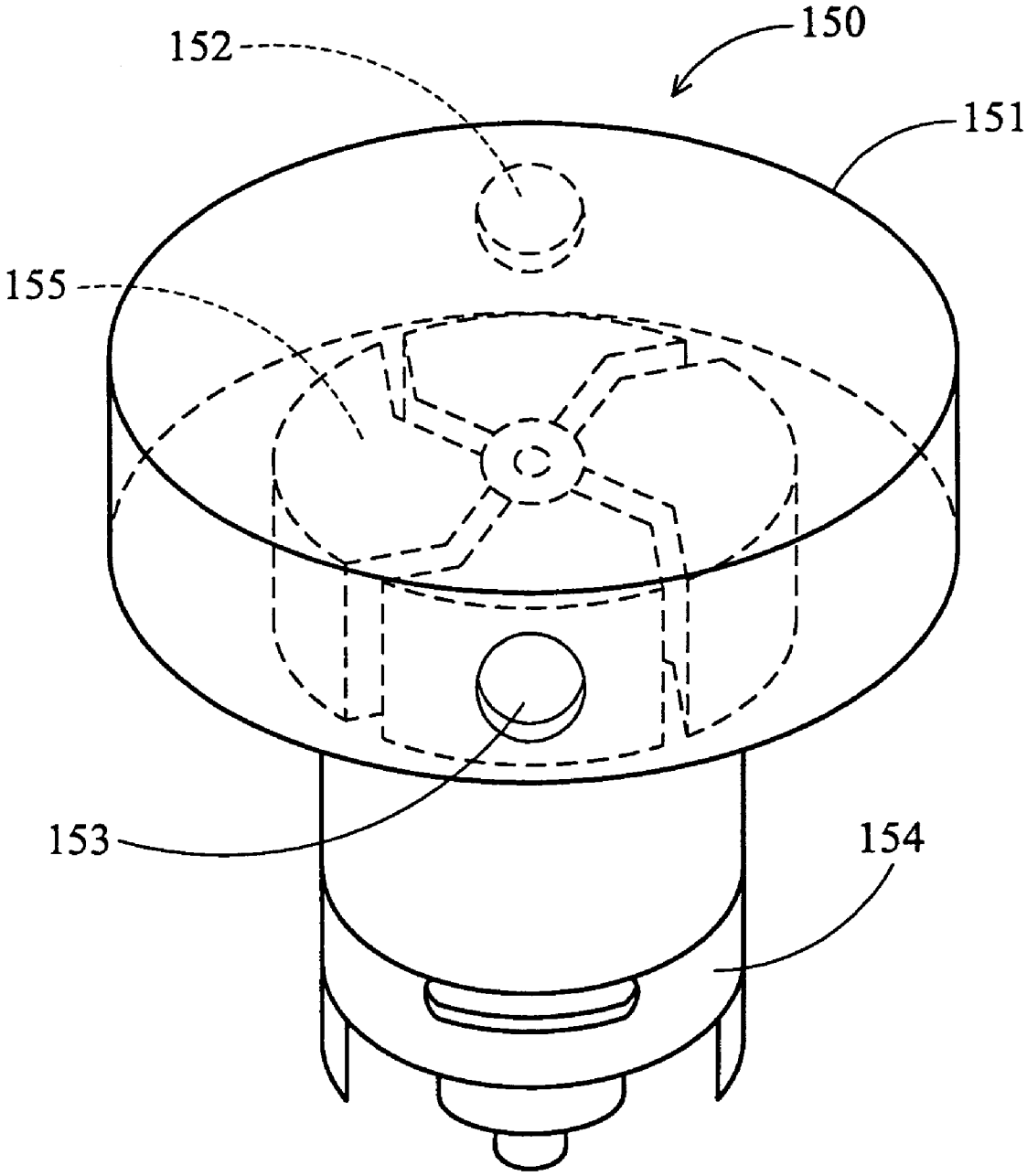
FIG. 10B is a perspective diagram of a fan assembly of FIG. 10A.
Figure 11:
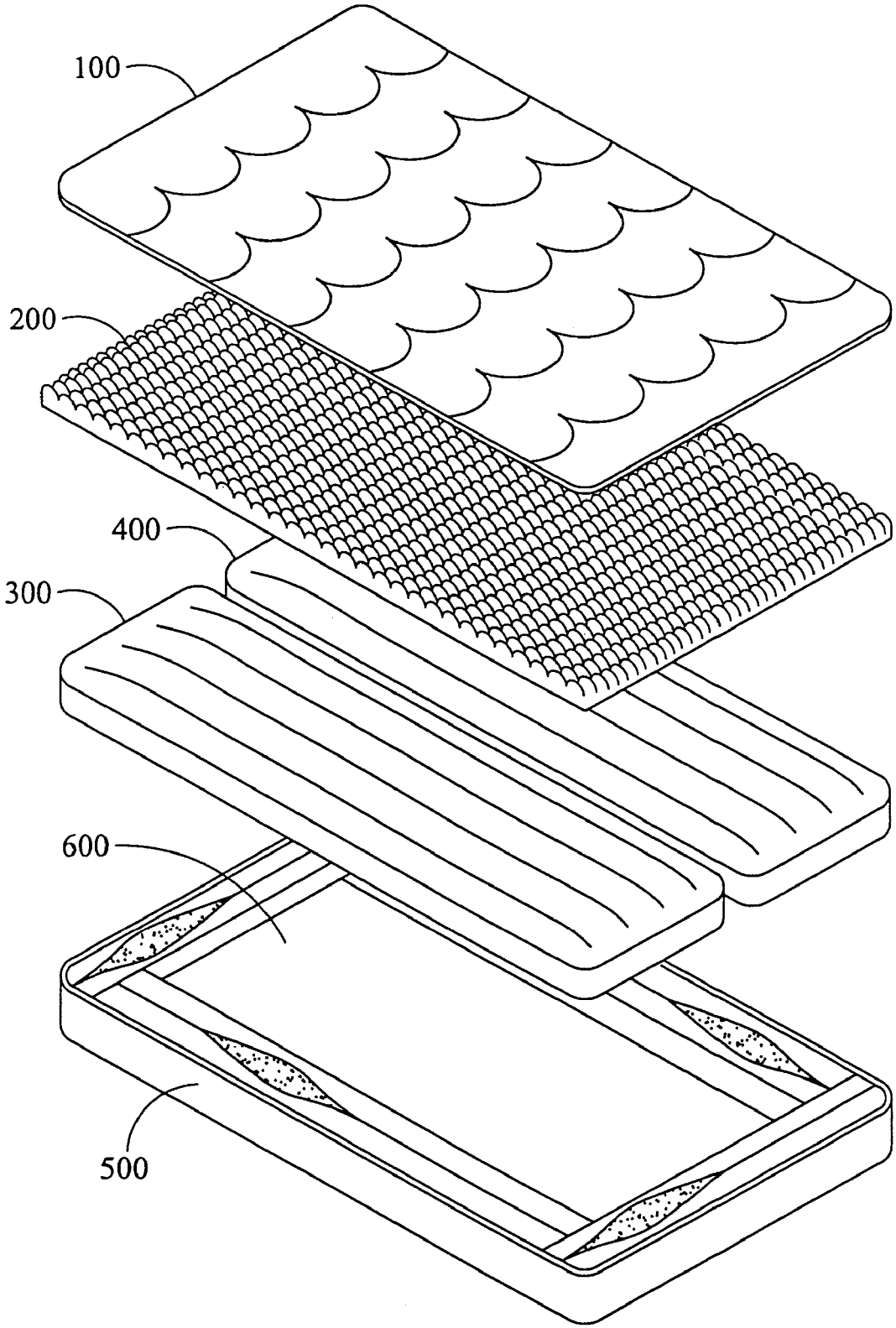
FIG. 11 ( PRIOR ART )
FIG. 11 is an exploded perspective diagram of a conventional air mattress.

FIGS. 10A and 10B show a modified inflatable umbrella, wherein the air pump of the ninth embodiment including the bellows 94, link 902, gears 901 and motor 93 are replaced with another kind of air pump 150. The air pump 150 includes a cylindrical reservoir 151, a fan (air pressure rotator) 155 eccentrically received in the reservoir 151, and a motor 154 provided outside the reservoir 151 to rotate the fan 155. The reservoir 151 has an air intake 152 connected to the first check valve 97 and an air outlet 153 connected to the third check valve 98. During operation, air is pumped into the reservoir 151 through the air intake 152 and then pumped out through the air outlet 153. Furthermore, it is noted that the fan 155 is eccentrically arranged in the reservoir 151. This fan assembly generates sufficient air pressure to inflate the umbrella.

While the invention has been described by way of example and in terms of the preferred embodiment, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An inflatable product including:

an inflatable body;

a fan and motor assembly for pumping air;

a housing built into the inflatable body, the housing having an interior region; and an air conduit disposed at least in part in the housing, the air conduit being movable between a first position and a second position while remaining disposed at least in part in the housing, the fan and motor inflating the inflatable body when the air conduit is in the first position, and deflating the inflatable body when the air conduit is in the second position;

wherein air flows between the interior region of the housing and the inflatable body during inflation and deflation.

2. The inflatable product as claimed in claim 1, wherein air flows from the interior region of the housing into the inflatable body when the air conduit is in the first position.

3. The inflatable product as claimed in claim 1, wherein air flows from the inflatable body into the interior region of the housing when the air conduit is moved to the second position.

4. The inflatable product as claimed in claim 1, wherein the air conduit is a pipe.

5. The inflatable product as claimed in claim 4, wherein the pipe is rotatable.

6. The inflatable product as claimed in claim 4, wherein the pipe is a switching pipe.

7. The inflatable product as claimed in claim 1, wherein the air conduit is arranged to convey air pumped by the fan and motor assembly.

8. The inflatable product as claimed in claim 7, wherein the air conduit has a first end and a second end, and wherein the fan and motor assembly causes air to be conveyed from the first end of the air conduit to the second end of the air conduit when the air conduit is in the first position.

9. The inflatable product as claimed in claim 8, wherein the fan and motor assembly causes air to be conveyed in sequence from ambient, through the first end of the air conduit, to the second end of the air conduit, and into the inflatable body when the air conduit is in the first position.

10. The inflatable product as claimed in claim 8, wherein the fan and motor assembly causes air to be conveyed from the second end of the air conduit to the first end of the air conduit when the air conduit is in the second position.

11. The inflatable product as claimed in claim 10, wherein the fan and motor assembly causes air to be conveyed in sequence from the inflatable body, through the second end of the air conduit, to the first end of the air conduit, to ambient when the air conduit is in the second position.

12. The inflatable product as claimed in claim 1, wherein the fan and motor are received in the housing.

13. An inflatable product including:

an inflatable body;

a housing built into the inflatable body, having a first opening and a second opening;

a fan and motor for pumping air; and a switching pipe disposed at least in part in the housing and having a first end and a second end, the switching pipe movable between a first position and a second position, the switching pipe arranged such that the first end of the switching pipe communicates with the first opening when the switching pipe is in the first position, and the first end of the switching pipe communicates with the second opening when the switching pipe is in the second position; wherein, on activation of the fan, air is pumped in sequence from the second opening to the first opening and through the switching pipe from the first end to the second end when the switching pipe is in a first position, and air is pumped is pumped in sequence from the second end to the first end of the switching pipe and through the second opening to the first opening when the switching pipe is in the second position.

14. The inflatable product as claimed in claim 13, wherein the housing comprises an interior region, and air flows between the interior region of the housing and the inflatable body when the inflatable body is inflated and deflated.

15. The air pump assembly recited in claim 13, wherein the fan and motor are received in the housing.

16. An inflatable product including:

an inflatable body;

a fan and motor assembly for pumping air;

a housing built into the inflatable body, the housing having an interior region; and an air conduit having a first end and a second end, the air conduit disposed at least in part in the housing and arranged to convey air pumped by the fan and motor assembly, the air conduit being movable between a first position and a second position, the fan and motor inflating the inflatable body when the air conduit is in the first position, and deflating the inflatable body when the air conduit is in the second position;

wherein air flows between the interior region of the housing and the inflatable body during inflation and deflation, and wherein the fan and motor assembly causes air to be conveyed from the first end of the air conduit to the second end of the air conduit when the air conduit is in the first position, and the fan and motor assembly causes air to be conveyed in sequence from the inflatable body, through the second end of the air conduit, to the first end of the air conduit, to ambient when the air conduit is in the second position.

17. The inflatable product as claimed in claim 16, wherein air flows from the interior region of the housing into the inflatable body when the air conduit is in the first position.

18. The inflatable product as claimed in claim 16, wherein air flows from the inflatable body into the interior region of the housing when the air conduit is moved to the second position.

19. The inflatable product as claimed in claim 16, wherein the air conduit is a pipe.

20. The inflatable product as claimed in claim 19, wherein the pipe is rotatable.

21. The inflatable product as claimed in claim 19, wherein the pipe is a switching pipe.

22. The inflatable product as claimed in claim 16, wherein the fan and motor assembly causes air to be conveyed in sequence from ambient, through the first end of the air conduit, to the second end of the air conduit, and into the inflatable body when the air conduit is in the first position.

23. The inflatable product as claimed in claim 16, wherein the fan and motor are received in the housing.

* * * * *